US008385586B2

(12) United States Patent
Liou et al.

(10) Patent No.: US 8,385,586 B2
(45) Date of Patent: Feb. 26, 2013

(54) FLAT LOUDSPEAKER STRUCTURE

(75) Inventors: Chang-Ho Liou, Changhua County (TW); Ming-Daw Chen, Hsinchu (TW); Kuo-Hua Tseng, Taipei County (TW)

(73) Assignee: Industrial Technology Research Institute, Hsinchu (TW)

( * ) Notice: Subject to any disclaimer, the term of this patent is extended or adjusted under 35 U.S.C. 154(b) by 428 days.

(21) Appl. No.: 12/759,710

(22) Filed: Apr. 14, 2010

(65) Prior Publication Data

US 2011/0033079 A1 Feb. 10, 2011

(30) Foreign Application Priority Data

Aug. 10, 2009 (TW) ..... 98126821 A

(51) Int. Cl.

| | |
|---|---|
| ***H04R 1/20*** | (2006.01) |
| ***H04R 9/06*** | (2006.01) |
| *H04R 1/00* | (2006.01) |
| *H04R 9/00* | (2006.01) |

(52) U.S. Cl. ..... 381/431; 381/191

(58) Field of Classification Search ..... 381/431, 381/190, 191, 189

See application file for complete search history.

(56) References Cited

U.S. PATENT DOCUMENTS

| | | | | |
|---|---|---|---|---|
| 3,646,280 | A * | 2/1972 | Tamura et al. | 381/191 |
| 3,778,561 | A * | 12/1973 | Reedyk | 381/113 |
| 3,833,770 | A * | 9/1974 | Atoji et al. | 381/116 |
| 3,894,198 | A * | 7/1975 | Murayama et al. | 381/114 |
| 3,894,199 | A | 7/1975 | Tamura et al. | |
| 3,894,333 | A * | 7/1975 | Chang | 29/594 |
| 3,942,029 | A * | 3/1976 | Kawakami et al. | 307/400 |
| 3,980,838 | A * | 9/1976 | Yakushiji et al. | 381/191 |
| 4,041,446 | A * | 8/1977 | Liebermann | 367/181 |
| 4,246,448 | A * | 1/1981 | Tam et al. | 381/111 |
| 4,250,415 | A * | 2/1981 | Lewiner et al. | 307/400 |
| 4,302,633 | A * | 11/1981 | Tamamura et al. | 307/400 |
| 6,075,867 | A * | 6/2000 | Bay et al. | 381/191 |
| 6,819,769 | B1 * | 11/2004 | Zimmermann | 381/152 |
| 7,769,193 | B2 * | 8/2010 | Matsuzawa | 381/191 |
| 8,081,784 | B2 * | 12/2011 | Liou et al. | 381/191 |
| 8,098,855 | B2 * | 1/2012 | Lee et al. | 381/191 |
| 8,103,028 | B2 * | 1/2012 | Li et al. | 381/191 |
| 8,107,651 | B2 * | 1/2012 | Liou et al. | 381/191 |
| 8,126,189 | B2 * | 2/2012 | Liou et al. | 381/431 |
| 8,139,794 | B2 * | 3/2012 | Chen et al. | 381/150 |
| 8,155,356 | B2 * | 4/2012 | Liou et al. | 381/191 |
| 8,196,282 | B2 * | 6/2012 | Chen et al. | 29/594 |
| 2007/0029899 | A1 * | 2/2007 | Matsuzawa | 310/334 |
| 2009/0060233 | A1 * | 3/2009 | Liou et al. | 381/191 |
| 2010/0024198 | A1 * | 2/2010 | Chen et al. | 29/594 |
| 2010/0027818 | A1 * | 2/2010 | Lee et al. | 381/191 |
| 2010/0104116 | A1 * | 4/2010 | Liou et al. | 381/191 |
| 2010/0166230 | A1 * | 7/2010 | Tseng et al. | 381/150 |
| 2010/0260370 | A1 * | 10/2010 | Chen et al. | 381/386 |
| 2011/0033079 | A1 * | 2/2011 | Liou et al. | 381/431 |
| 2011/0146056 | A1 * | 6/2011 | Liou et al. | 29/592.1 |
| 2011/0216921 | A1 * | 9/2011 | Tseng et al. | 381/164 |

(Continued)

*Primary Examiner* — Edgardo San Martin
(74) *Attorney, Agent, or Firm* — Jianq Chyun IP Office

(57) ABSTRACT

A flat loudspeaker structure is provided. A conductive electrode of a vibrating membrane of a flat speaker unit is disposed on both utmost sides of the flat speaker unit, so as to improve reliability of the flat speaker unit. The utmost conductive electrodes of the flat speaker unit are further grounded to achieve the EMI preventing function and/or thereby prevent a user from a risk of contacting high voltages. The flat speaker unit at least includes a pair of vibrating membranes each having the conductive electrode, a plurality of supporting members, a perforated electrode structure with a plurality of holes, and an insulator layer.

27 Claims, 28 Drawing Sheets

U.S. PATENT DOCUMENTS

2011/0255719 A1* 10/2011 Liou et al. ..... 381/191
2011/0255720 A1* 10/2011 Kao et al. ..... 381/191
2011/0255721 A1* 10/2011 Chen et al. ..... 381/191
2012/0002826 A1* 1/2012 Wu et al. ..... 381/191
2012/0051564 A1* 3/2012 Liou et al. ..... 381/191
2012/0121112 A1* 5/2012 Lin et al. ..... 381/191

* cited by examiner

FLAT LOUDSPEAKER STRUCTURE

CROSS-REFERENCE TO RELATED APPLICATION

This application claims the priority benefit of Taiwan application serial no. 98126821, filed on Aug. 10, 2009. The entirety of the above-mentioned patent application is hereby incorporated by reference herein and made a part of this specification.

TECHNICAL FIELD

The disclosure relates to a flat loudspeaker. And, the disclosure relates to a flat loudspeaker structure with an electromagnetic interference (EMI) preventing function.

BACKGROUND

The most direct two senses of human beings are vision and audition, and thus scientists have been endeavored to develop various sight and sound reproduction systems for a long time. Currently, a moving-coil loudspeaker plays a dominant role in the entire loudspeaker market. In the recent years, however, to bring more sonic sensuality and comply with requirements for short, tiny, small, and compact 3C (computer, communication, and consumer electronics) products, a power-saving compact speaker with a proper ergonomic design is going to be far more extensively applied in various forms, such as a large-size flat loudspeaker, an earphone set of a walkman, a cellular phone with three-dimensional surrounding sound effects, and so on.

At present, a loudspeaker can be categorized into a direct-radiating speaker and an indirect-radiating speaker. Besides, based on a driving mechanism, the loudspeaker can be classified into a moving-coil loudspeaker, a piezoelectric speaker, and an electrostatic loudspeaker. The moving-coil loudspeaker is the most common and mature speaker by now, while the intrinsic structural properties of the moving-coil loudspeaker do not conform to the requirements for miniaturizing the 3C products and reducing the size of home theater systems.

The piezoelectric speaker uses piezoelectric materials that have the property of converting electrical energy into mechanical energy by undergoing a controllable amount of deformation when subjected to an applied electric field. Thereby, vibrating membranes in the piezoelectric speaker can make a sound. Note that the piezoelectric speaker has a compact size. The electrostatic loudspeaker is now mainly applied to hi-end headsets and audio systems. In a conventional electrostatic loudspeaker, a capacitor is formed by a conductive vibrating membrane sandwiched between two perforated fixed electrode boards. By supplying a direct bias voltage to the conductive vibrating membrane and supplying an alternating voltage to the two fixed electrode boards, the conductive vibrating membrane oscillates because of the electrostatic force generated by positive and negative electric fields, such that sound is radiated. The direct bias voltage provided to the conventional electrostatic speaker must reach hundreds or even thousands of volts, and therefore an amplifier with high unit price and significant volume is required. Said disadvantage discourages popularization of the conventional electrostatic speaker.

When the electrostatic speaker requiring high voltages is operated, electromagnetic interference (EMI) can be expected. Hence, to be compliant with relevant international standards, the disclosure is directed to a flat loudspeaker structure capable of preventing the EMI. With proper driving modules, the utmost electrodes of the flat loudspeaker structure are grounded to not only prevent the EMI but also protect a user from a risk of electrocution. Besides, when a sound pressure power level is increased, an issue arising from the complicated structure and circuits of the conventional flat loudspeaker structure can also be resolved according to the disclosure. With the simple structure, the flat loudspeaker of the disclosure can be mass-produced by performing existing manufacturing processes.

In the future, audio plays an important role in applications of soft electronics. Since the soft electronics are soft, thin, low-power driven, and flexible, how to achieve the breakthrough of the conventional design and fabricate the parts equipped with soft electronic properties remains as one of the main purposes of the disclosure.

SUMMARY

In one of embodiments, a flat loudspeaker includes at least a plurality of flat speaker units. Each of the flat speaker units includes a perforated electrode structure having a plurality of holes, a vibrating membrane structure, and a supporting layer. A conductive electrode is disposed on a surface of the vibrating membrane structure. The supporting layer is disposed between the vibrating membrane structure and the perforated electrode structure. Besides, the supporting layer has a frame and a plurality of supporting members. The vibrating membrane structure, the supporting layer, and the perforated electrode structure are sequentially stacked to form the flat speaker unit. The flat loudspeaker structure is a stacked structure including at least two of the flat speaker units, and a space among the vibrating membrane structure, the perforated electrode structure, and the supporting layer of each of the flat speaker units serves as a resonance space of the flat loudspeaker structure.

In one of embodiments, a structure of a flat speaker unit of a flat loudspeaker is provided. The flat speaker unit includes two vibrating membrane structures, two supporting layers, and a perforated electrode structure disposed between the two supporting layers. The vibrating membrane structures, the supporting layers, and the perforated electrode structure are stacked together. A conductive electrode is respectively disposed on surfaces of the two vibrating membrane structures. The two supporting layers are respectively disposed between the vibrating membrane structures and the perforated electrode structure. Besides, the two supporting layers respectively have a frame and a plurality of supporting members having an arranged pattern layout.

It is to be understood that both the foregoing general descriptions and the following detailed embodiments are exemplary and are, together with the accompanying drawings, intended to provide further explanation of technical features and advantages of the embodiment.

BRIEF DESCRIPTION OF THE DRAWINGS

The accompanying drawings are included to provide a further understanding of the embodiment, and are incorporated in and constitute a part of this specification. The drawings illustrate embodiments and, together with the description, serve to explain the principles of the embodiment.

DESCRIPTION OF EMBODIMENTS

Figure 1:
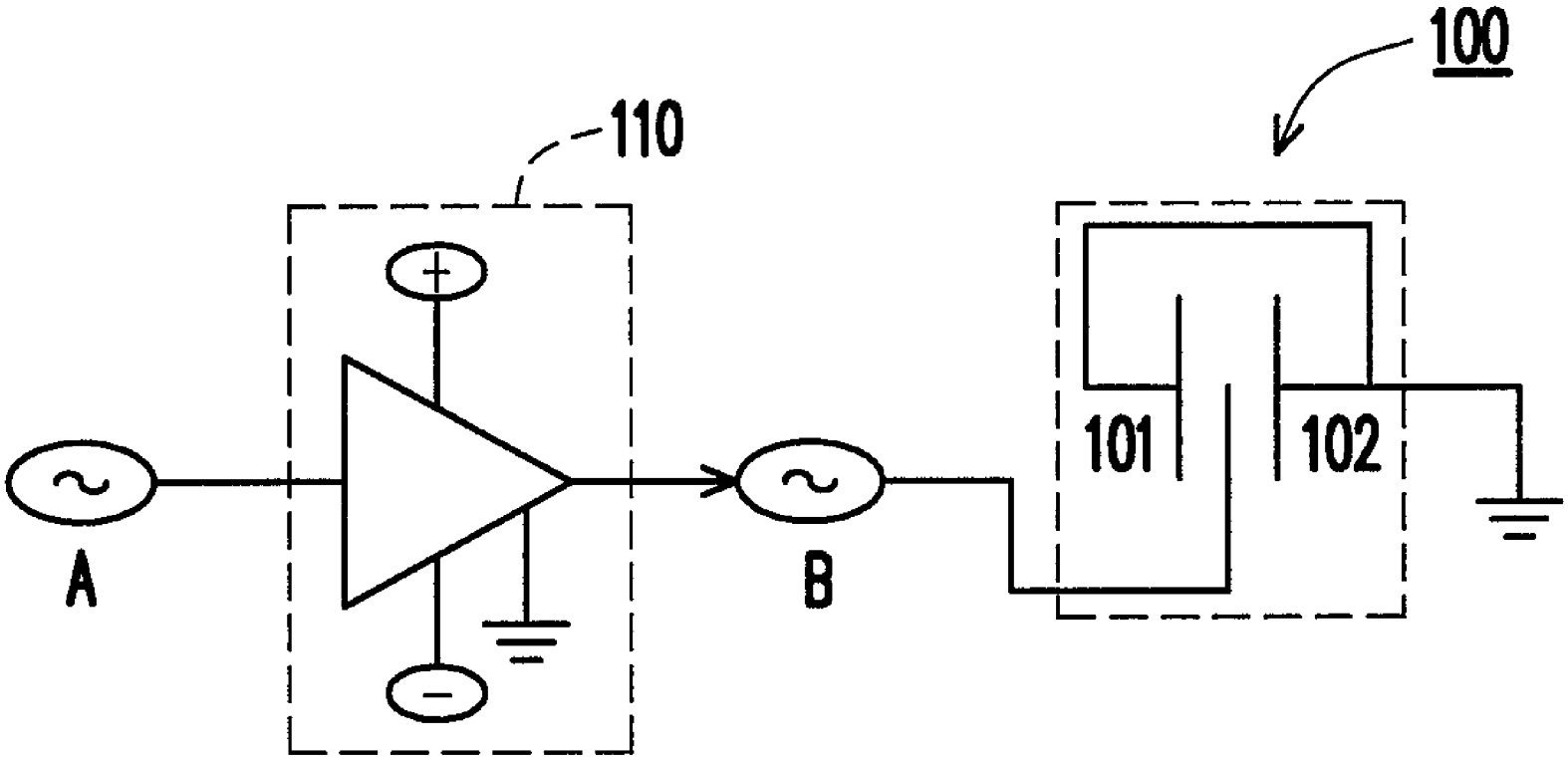
FIG. 1 is a schematic view illustrating circuits of a flat loudspeaker.

In one of embodiments, a flat loudspeaker structure is introduced herein. In one example, the flat loudspeaker structure may be capable of having an EMI preventing function. In the flat loudspeaker structure, a conductive electrode of an electret vibrating membrane is disposed on both utmost sides of a flat speaker unit to improve reliability. The utmost conductive electrodes of the flat speaker unit are further grounded, so as to, in one of the examples, achieve the EMI preventing function and/or thereby prevent a user from a risk of contacting high voltages.

According to another embodiment, the flat speaker unit at least includes a pair of electret vibrating membranes each having the conductive electrode, a plurality of supporting members, a perforated electrode structure, and an insulator layer. The perforated electrode structure is disposed at the utmost side of the flat speaker unit and grounded. By contrast, in another embodiment, the conductive electrodes in the vibrating membrane structure of the flat speaker unit are disposed at the utmost sides of the flat speaker unit and grounded.

According to an embodiment, an output sound pressure level may be increased by assembling a plurality of flat speaker units. Besides, when the sound pressure power level is increased, an issue arising from the complicated structure and circuits of the flat loudspeaker structure can also be resolved according to the embodiment.

The utmost electrode of the electret speaker has a voltage over tens or hundreds voltages, which may result in the EMI effect and easily causes a user to be electrocuted if the user contacts a surface of the electret speaker. According to this embodiment, the utmost electrode is grounded to prevent the EMI effect and the risk of electrocution. With the simple structure, the flat loudspeaker of the embodiment can be mass-produced by performing existing manufacturing processes. The flat loudspeaker of the embodiment can be formed by flexible and bendable speaker units. Certainly, a material of the flexible and bendable speaker units may be chosen so as not to affect the characteristics of the flat loudspeaker of the embodiment when the speaker units are bent.

According to an embodiment, all components of the speaker unit may be made of soft materials, while all the components of the speaker unit may be made of transparent materials in another embodiment.

In the embodiment, a signal source may be amplified by a single-in single-out amplifier, so as to output and transmit audio signals to the flat loudspeaker of the embodiment. The signal source may also be amplified by a single-in differential-out amplifier to output the audio signals in another embodiment. According to the embodiment, in the loudspeaker structure, a plurality of flat speaker units may be driven by the same set of signals. In another embodiment, a plurality of flat speaker units may be driven by the same set of differential-out signals in the loudspeaker structure. The utmost electrodes of the flat speaker units are grounded to, for example, prevent the EMI and/or effectively increase the sound power level of the flat loudspeaker structure at the same time.

Owing to properties of electric charges in electret materials as well as electrostatic effects, when electret vibrating membranes are stimulated by external voltages, deformation perpendicular to or parallel to surfaces of the electret vibrating membranes is induced. If four sides of the electret vibrating membranes are secured, the aforesaid deformation perpendicular to or parallel to the surfaces of the electret vibrating membranes can be transformed into bending distortion, and sound is then generated by driving air around the electret vibrating membranes. Based on a formula representing the electrostatic force and the energy law, it is known that a force loaded onto the vibrating membrane structure is equal to the product of the capacitance of the entire loudspeaker structure, the internal electric field, and the input audio voltage signal. The greater the force loaded onto the vibrating membrane structure, the louder the output sound, which is detailed hereinafter.

In accordance with the Coulomb's law, the product of magnitudes of two electric charges is directly proportional to the magnitude of the electrostatic force between the two electric charges and inversely proportional to the square of the total distance between the two electric charges. The two electric charges both being positive or negative imply a repulsive interaction, while the two electric charges respectively being positive and negative imply an attractive interaction. The electret of this embodiment can be an electro acoustic actuator made of an electret composite material having nano holes. The electret has an electret vibrating membrane equidistantly sandwiched by two perforated flat boards having electric charges, i.e. the electret has a capacitor-like structure. The two perforated flat boards respectively carry positive and negative voltages resulting from audio signals. According to the Coulomb's law, a repulsive electrostatic force and an attractive electrostatic force are simultaneously applied to the sandwiched electret vibrating membrane, and the electrostatic forces loaded onto the vibrating membrane per unit area can be represented by the following formula (1):

$$P = \frac{2V_{in}V_e\varepsilon_0\left(\frac{1}{S_a} + \frac{\varepsilon_e}{S_e}\right)\varepsilon_e S_e}{(S_e + \varepsilon_e S_a)^2} \quad \text{(formula 1)}$$

Here, the permittivity of vacuum $\in_o=8.85*10^{-12}$ F/m, $\in_e$ is a dielectric constant of the electret, $S_e$ is the thickness of the electret, $S_a$ is the thickness of air, $V_{in}$ is a voltage of the input signal, $V_e$ is a voltage of the electret, and p is the force loaded onto the vibrating membrane per unit area. It can be learned from the formula (1) that the electrostatic force is directly proportional to the product of the bias and the audio signal voltage and is inversely proportional to the distance between the perforated flat boards and the electret vibrating membrane. Hence, on the condition of same distance, if the electrostatic speaker can provide an electret with high electric strength, the required electrostatic force can be obtained with a relatively low audio signal alternating voltage.

Based on the above, when the positive bias and the negative bias of the two electrode boards are applied to the electret vibrating membrane, a push-pull electrostatic force is loaded onto the electret vibrating membrane, such that the electret vibrating membrane oscillates and compresses the surrounding air to output sound.

The aforesaid perforated electrodes can be made of metallic materials in an embodiment or made of elastic materials in another embodiment, such as paper or an extremely thin non-conductive material layer on which a metallic thin film is coated.

When the perforated electrodes are made of the non-conductive material on which the metallic thin film is coated, the non-conductive material can be plastic, rubber, paper, or non-conductive fabric (cotton fiber or polymer fiber) or combination thereof, while the metallic thin film can be aluminum, gold, silver, copper, an alloy thereof, an Ni/Au bi-metal material, one of indium tin oxide (ITO) and indium zinc oxide (IZO) or a combination thereof, or poly(3,4-ethylene dioxythiophene) (PEDOT), or combination thereof.

In another embodiment, when the perforated electrodes are made of the conductive material, the conductive material can be metal (iron, copper, aluminum, or an alloy thereof) or conductive fabric (metallic fiber, metal oxide fiber, carbon fiber, or graphite fiber).

In this embodiment, the electret vibrating membrane can be an electret piezoelectric vibrating membrane made of an electrized dielectric material which can have long-lasting static charges, and the electret vibrating membrane can be made of one layer of a dielectric material or plural layers of dielectric materials, such as fluorinated ethylenepropylene (FEP), polytetrafluoethylene (PTFE), polyvinylidene fluride (PVDF), fluorine polymer, or other appropriate materials. Besides, nano-micro holes are in the dielectric material. The electret vibrating membrane is made of the dielectric material and is electrized to equip the electret vibrating membrane with the long-lasting static charges and piezoelectric properties, and the nano-micro holes in the dielectric material can improve transparency and promote piezoelectric properties. Accordingly, after the mechanism of corona charge is lifted, dipolar charges are generated in the dielectric material, and the piezoelectric effect can be achieved.

Currently, sound pressure of the flat speaker unit is likely to discourage immediate improvement of sound volume because of material or design defects, and the sound volume should therefore be raised by increasing the electric strength of the electret vibrating membrane or improving the acoustic structure. However, the above-mentioned solutions are time-consuming and not able to achieve immediate improvement of sound volume. Hence, one or more of embodiments are also directed to the flat speaker unit which is well designed to raise the sound volume.

In one of embodiments, the flat speaker units are assembled without changing the input signal source. Instead, the utmost perforated electrode structures are grounded to the input signal source. Namely, the utmost electrodes on the vibrating membranes of the flat speaker units are grounded and connected to the sound source to, for example, prevent the EMI and/or protect a user from the risk of contacting high voltages.

When the input audio signal is output in a differential-out manner, the vibrating membrane structures of the flat speaker units are homopolar.

Based on the above-mentioned designs, the flat speaker unit can be assembled without complex circuits in order to comply with sound pressure standards of products. Electric charges of electrets in the flat speaker units are arranged based on odd or even polarity. Through supplying one set of external audio signals and applying an audio signal input design, the output volume can be increased. Different embodiments are provided below to elucidate applications of the highly reliable loudspeaker structure and plural sets of stacked structures.

Single-Ended In/Single-Ended Out Double-Layered Heteropolar Flat Speaker Unit

FIG. 1 is a schematic view illustrating circuits of a flat loudspeaker. As shown in FIG. 1, a signal source A is amplified by a single-ended in/single-ended out (single-in single-out) amplifier 110 to generate an audio signal B transmitted to a flat loudspeaker 100 according to an embodiment. In the flat loudspeaker 100, electric potentials of metal electrodes 101 and 102 are the same, and the metal electrodes 101 and 102 are grounded to prevent the EMI and/or the risk of electrocution.

Figure 2A:
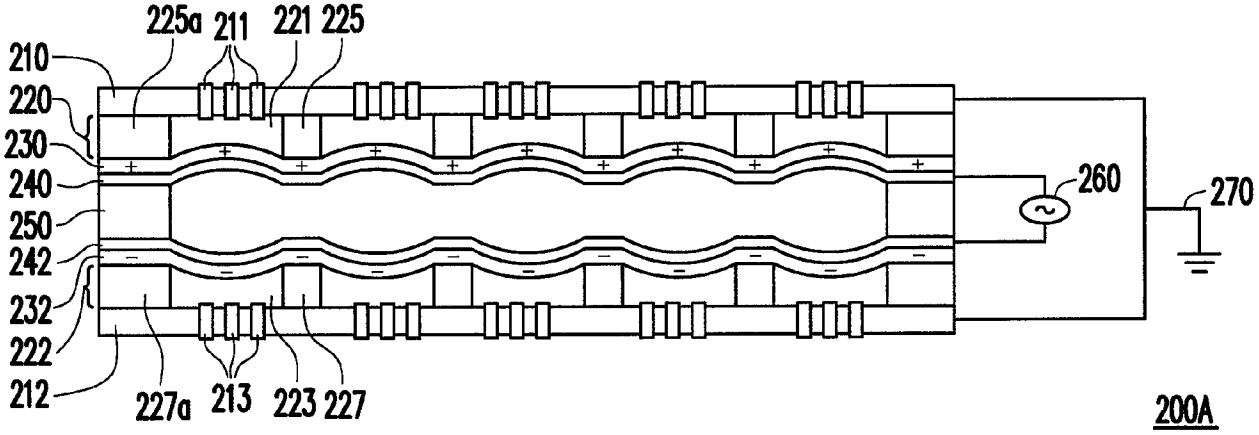
FIGS. 2A to 2C are schematic cross-sectional views illustrating a double-layered heteropolar flat loudspeaker structure according to one of embodiments.
Figure 2B:
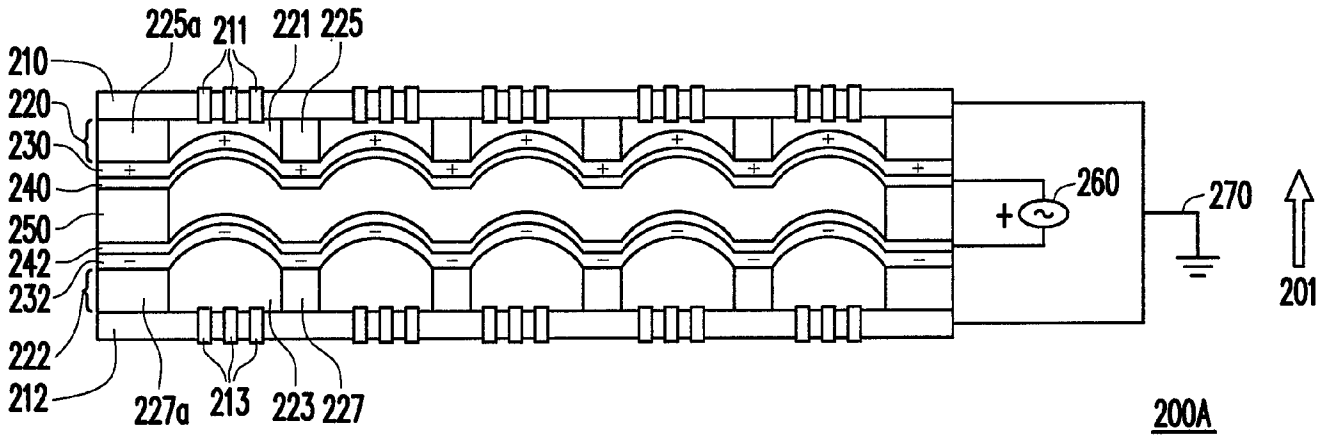
Figure 2C:
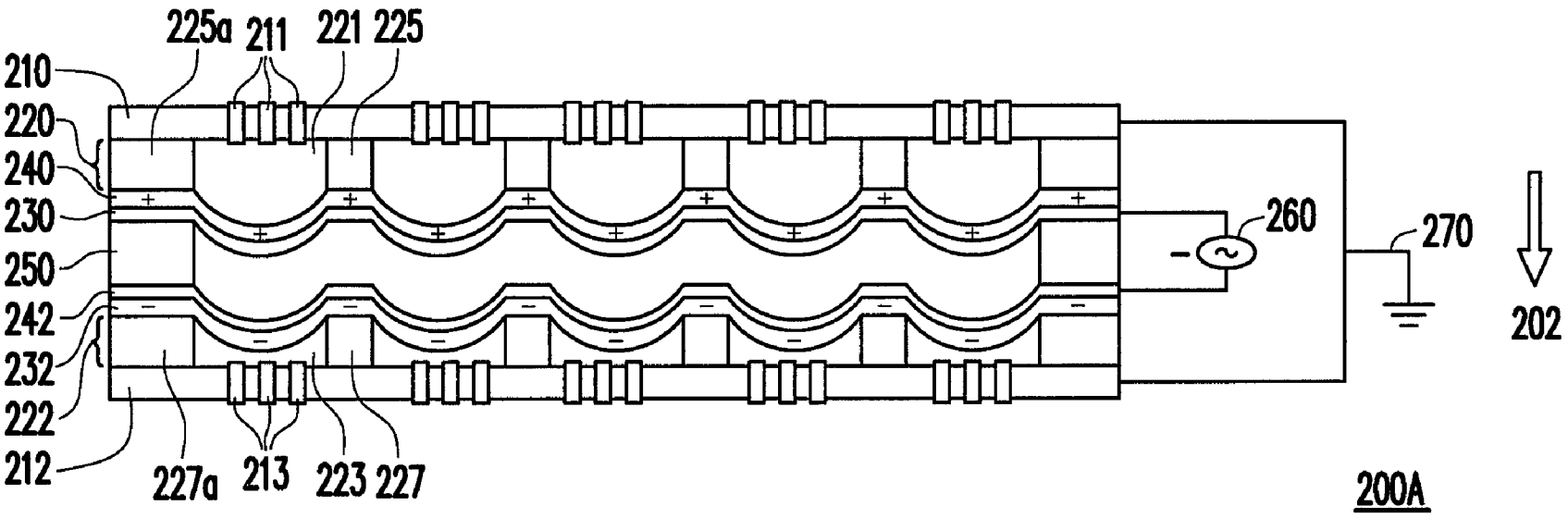

The design of obtaining the audio signal with the single-ended in/single-ended out amplifier 110 is illustrated in FIGS. 2A to 2C. FIGS. 2A to 2C are schematic cross-sectional views illustrating flat speaker units in a double-layered flat loudspeaker structure according to different embodiments. In the embodiments, a vibrating membrane material having a conductive electrode layer (e.g. a metal electrode) is disposed in the double-layered flat speaker unit. A perforated electrode structure is disposed at utmost sides of the speaker unit and grounded to prevent the EMI and/or protect the user from contacting high voltages.

First, in FIG. 2A, a flat speaker unit 200A of this embodiment is formed by stacking upper and lower vibrating membrane structures and the perforated electrode structure, and an insulator layer 250 is disposed therebetween for electrical insulation. Each of the vibrating membrane structures has a corresponding perforated electrode structure located at the utmost side of the flat speaker unit 200A, such as the perforated electrode structure 210 facing the vibrating membrane 230 and the perforated electrode structure 212 facing the vibrating membrane 232. The perforated electrode structures 210 and 212 respectively have a plurality of holes (e.g. the depicted holes 212 and 213) for circulating air between a resonance space and the external space.

The vibrating membrane structure includes an electret vibrating membrane and a conductive electrode thereof, such as the upper vibrating membrane 230 and the metal electrode 240 and the lower vibrating membrane 232 and the metal electrode 242. A supporting layer can be selectively disposed between each vibrating membrane structure and the corresponding perforated electrode structure, so as to support the vibrating membrane structure and form a plurality of operation regions. Thereby, short circuit caused by the contact between the vibrating membranes 230 and 232 and the corresponding perforated electrode structures 210 and 212 because of electrostatic effects can be prevented. Additionally, the operation regions can serve as space allowing the vibrating membranes 230 and 232 to oscillate. The aforesaid supporting layer is, for example, the supporting layer 220 disposed between the vibrating membrane 230 and the perforated electrode structure 210 or the supporting layer 222 disposed between the vibrating membrane 232 and the perforated electrode structure 212. The supporting layers 220 and 222 respectively include a frame and a plurality of supporting members to form a pattern layout. For instance, the supporting layer 220 has a frame 225*a* and a plurality of supporting members 225, and the supporting members 225 have different arrangements of patterns. On the other hand, the supporting layer 222 has a frame 227*a* and a plurality of supporting members 227, and the supporting members 227 have different arrangements of patterns. Thereby, resonance spaces 221 and 223 as shown in the drawings are formed.

Here, the frame can have a geometrical shape including a rectangular shape, a square shape, a triangular shape, a circular shape, or an elliptical shape. The pattern structures of the supporting layers can prevent the electrostatic effects that are possibly induced between the vibrating membranes and the perforated electrode structures in the flat loudspeaker structure. For instance, based on different demands, the layout of the supporting layer 230 between the perforated electrode structure 240 and the vibrating membrane 220 can be determined In consideration of the electrostatic effects of the vibrating membrane 220, the layout can have a geometrical arrangement, such as a quasi-rectangular arrangement, a circular arrangement, a triangular arrangement, and so on. The geometrical arrangement can be determined on account of the distance among the supporting members or the height of the supporting members. In addition, a dot layout, a grid layout, or a cross-like layout is also applicable. The supporting members can also have different geometrical shapes, such as a triangular-column shape, a cylindrical shape, a rectangular shape, and so forth.

The properties of electric charges in the electret material and the electrostatic effects are taken into consideration in the one or more of embodiments. Here, the vibrating membrane can be made of an electret piezoelectric material into which positive electric charges or negative electric charges are injected to result in different effects. According to this embodiment, the vibrating membranes 230 and 232 of the flat speaker unit 200A have heteropolar electric charges. As shown in the drawings, the vibrating membrane 230 has the positive electric charges, while the vibrating membrane 232 has the negative electric charges. The signal source 260 for providing the audio signals is from the single-ended in/single-ended out amplifier, and the connection relation is shown in FIG. 2A. One end of the signal source 260 is connected to the metal electrode 240 of the vibrating membrane 230, while the other end of the signal source 260 is connected to the metal electrode 242 of the vibrating membrane 232. To prevent the EMI and the risk of electrocution, the utmost perforated electrode structures 210 and 212 are connected to the ground 270 according to this embodiment, such that surplus electric charges in the perforated electrode structures 210 and 212 can enter the ground.

In FIG. 2A, voltages are not yet supplied to the metal electrodes 240 and 242 by the signal source 260, whereas the vibrating membranes 230 and 232 already carry the electric charges. Hence, an attractive force is generated between the positive electric charges of the vibrating membrane 230 and the perforated electrode structure 210 because of the electrostatic effect, and an attractive force is generated between the negative electric charges of the vibrating membrane 232 and the perforated electrode structure 212 because of the electrostatic effect. Thereby, the vibrating membranes 230 and 232 are slightly bent toward the resonance spaces 221 and 223.

As shown in FIG. 2B, when the positive voltage of the signal source 260 is transmitted to the metal electrode 240, a repulsive force is generated between the positive voltage on the metal electrode 240 and the positive electric charges of the vibrating membrane 230, such that the vibrating membrane 230 is bent toward and compresses the resonance space 221. At the same time, when the positive voltage of the signal source 260 is transmitted to the metal electrode 242, an attractive force is generated between the positive voltage on the metal electrode 242 and the negative electric charges of the vibrating membrane 232, such that the vibrating membrane 232 is bent toward a direction away from the resonance space 223, and that the resonance space 223 is then enlarged. Accordingly, a force-loading direction of the entire vibrating membrane structure is shown as an arrow 201.

In FIG. 2B, one phase of the audio signals of the signal source 260 is depicted, which should not be construed as a limitation of the embodiment. For instance, when the phase is inversed, i.e. when the negative voltage of the signal source 260 is transmitted to the metal electrode 240 as shown in FIG. 2C, an attractive force is generated between the negative voltage of the metal electrode 240 and the positive electric charges of the vibrating membrane 230, such that the vibrating membrane 230 is bent toward a direction away from the resonance space 221.

By contrast, when the negative voltage of the signal source 260 is transmitted to the metal electrode 242, a repulsive force is generated between the negative voltage on the metal electrode 242 and the negative electric charges of the vibrating membrane 232, such that the vibrating membrane 232 is bent toward and compresses the resonance space 223, and that the resonance space 223 is then reduced. Accordingly, a force-loading direction of the entire vibrating membrane structure is shown as an arrow 202, which is the reverse direction of the arrow 201.

Owing to the properties of the electric charges in the electret materials and the electrostatic effects, when the electret vibrating membranes in the flat speaker unit 200A are affected by external voltages, deformation substantially perpendicular to or parallel to surfaces of the electret vibrating membranes is induced. If the four sides of the electret vibrating membranes are secured, the aforesaid deformation substantially perpendicular to or parallel to the surfaces of the electret vibrating membranes can be transformed into bending distortion, and sound is then generated by driving air around the electret vibrating membranes. Besides, the audio signals that have alternative phases and are provided by the signal source 260 allow the flat speaker unit 200A to generate sound at different frequencies or with different volumes due to different force-loading directions of the vibrating membranes.

Figure 3A:
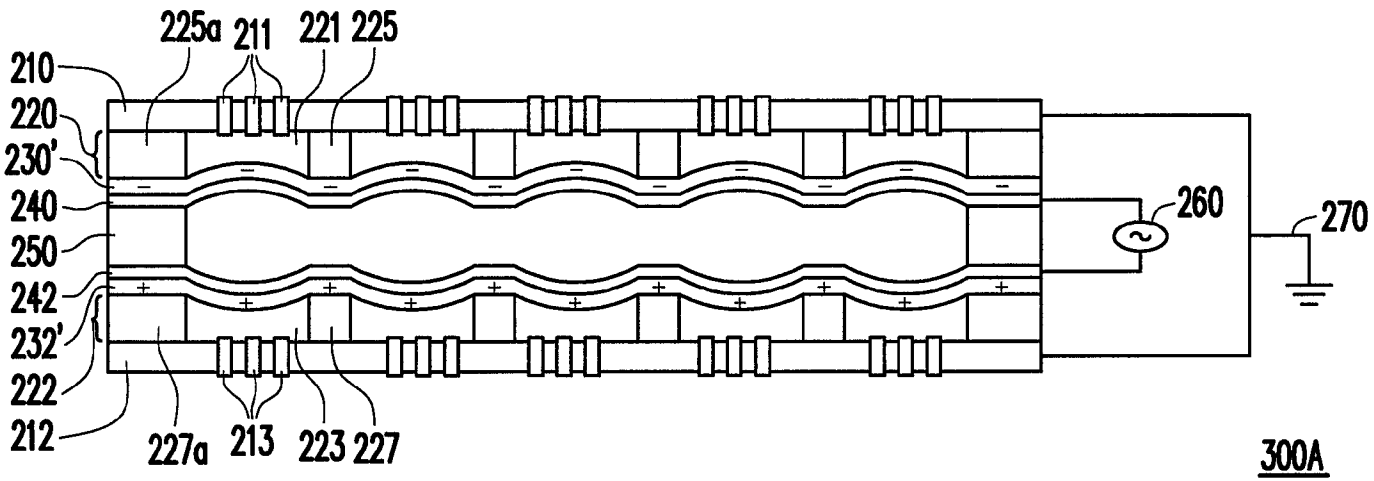
FIGS. 3A to 3C are schematic cross-sectional views illustrating a double-layered heteropolar flat loudspeaker structure according to one of embodiments.
Figure 3B:
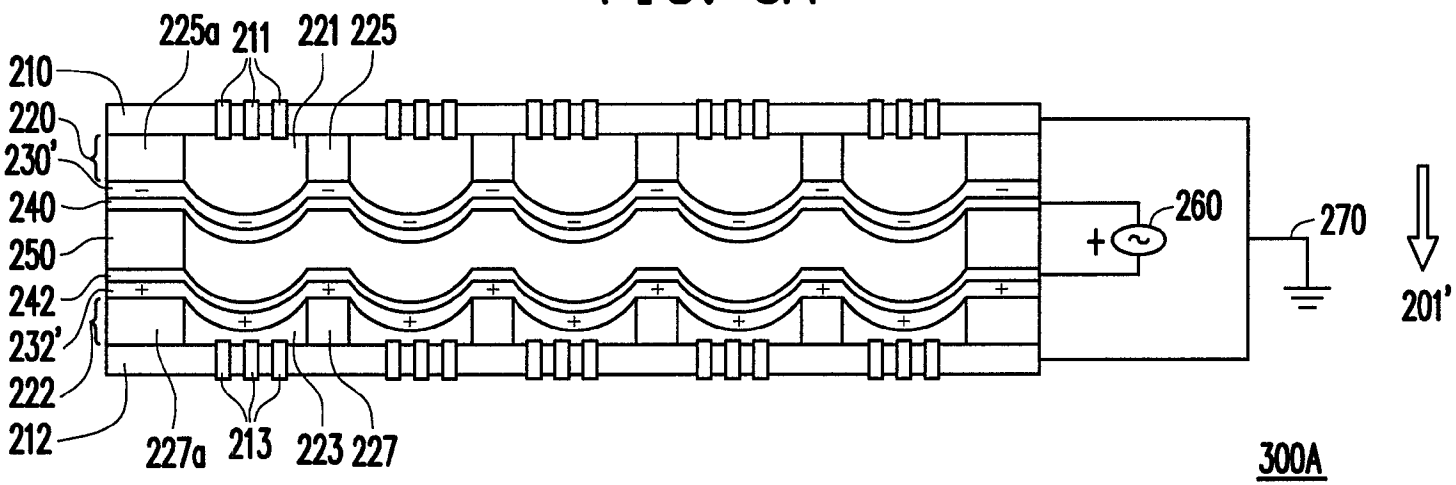
Figure 3C:
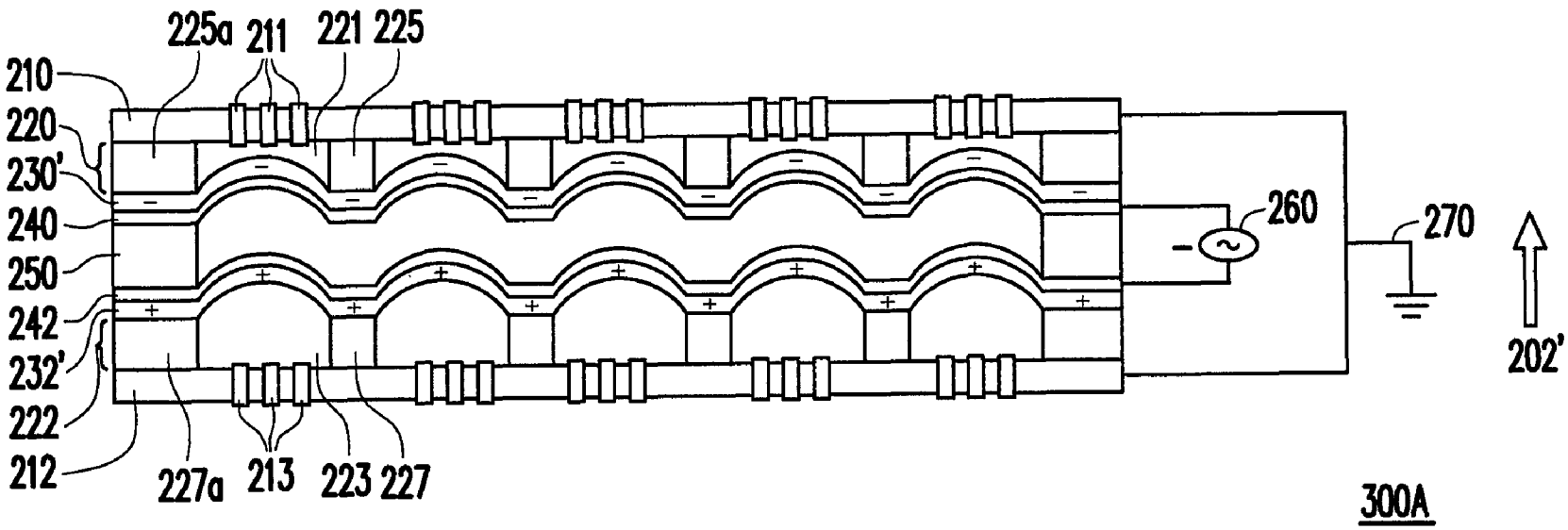

Please refer to FIGS. 3A to 3C which are schematic views illustrating a structure of a flat speaker unit and operation thereof according to one of embodiments. The flat speaker unit 300A of this embodiment is formed by stacking upper and lower vibrating membrane structures and the perforated electrode structure, and an insulator layer 250 is disposed therebetween for electrical insulation. The components of the flat speaker unit 300A are marked with the same reference numbers as those of the components of the flat speaker unit 200A depicted in FIGS. 2A to 2C, and therefore no further description is provided herein.

In the embodiment, the vibrating membrane 230 carries the negative electric charges, while the vibrating membrane 232 carries the positive electric charges. When the audio signal having the same phase as described in the previous embodiment is input, the force-loading directions of the vibrating membranes in this embodiment are opposite to the force-loading directions of the vibrating membranes in the above embodiment, while other processes remain similar to those mentioned in the previous embodiment. Hence, no further description is provided herein. In FIG. 3A, voltages are not yet supplied to the metal electrodes 240 and 242 by the signal source 260, whereas the vibrating membranes 230 and 232 already carry the electric charges. Therefore, an attractive force is generated between the negative electric charges of the vibrating membrane 230 and the perforated electrode structure 210 because of the electrostatic effect, and an attractive force is generated between the positive electric charges of the vibrating membrane 232 and the perforated electrode structure 212 because of the electrostatic effect. As such, the vibrating membranes 230 and 232 are slightly bent toward the resonance spaces 221 and 223.

Figure 4A:
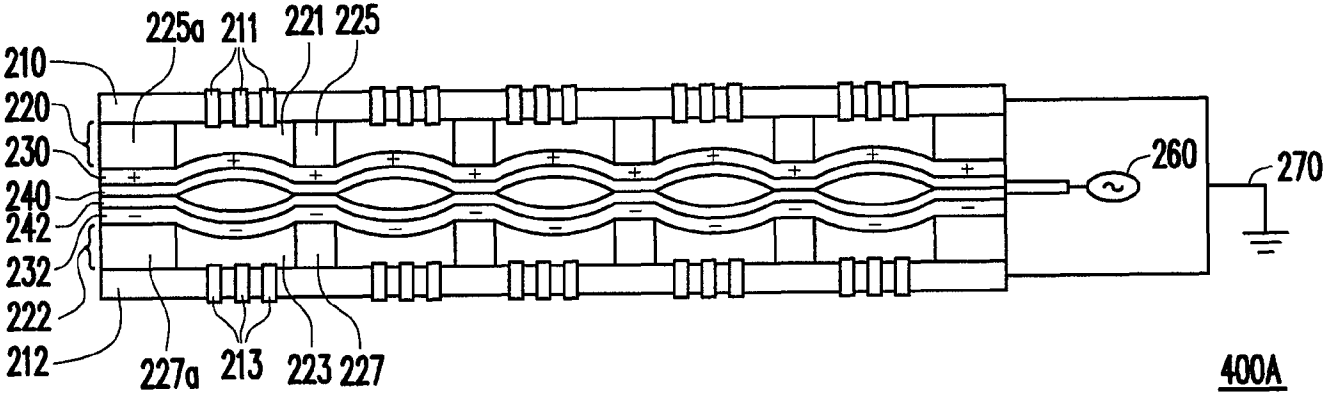
FIGS. 4A to 4C are schematic cross-sectional views illustrating stacked double-layered heteropolar flat speaker units in a loudspeaker structure according to one of embodiments.

In another embodiment, no insulator layer 250 is disposed in the double-layered flat speaker unit. Please refer to FIG. 4A. FIG. 4A is a schematic cross-sectional view illustrating a double-layered flat speaker unit 400A in the double-layered flat loudspeaker structure of the embodiment. The structure of the double-layered flat speaker unit 400A is similar to the flat speaker unit 200A depicted in FIG. 2A. Thus, same components of the flat speaker unit 400A and the flat speaker unit 200A are labeled by the same reference numbers, and no further descriptions are provided herein. The difference therebetween lies in that the insulator layer 250 depicted in FIG. 2A does not exist between the metal electrodes 240 and 242. Namely, the upper and the lower flat speaker units are formed by bonding the metal electrodes 240 and 242 together.

According to this embodiment, the vibrating membranes 230 and 232 of the flat speaker unit 400A have heteropolar electric charges. As shown in the drawings, the vibrating membrane 230 has the positive electric charges, while the vibrating membrane 232 has the negative electric charges. The signal source 260 for providing the audio signals is from the single-ended in/single-ended out amplifier, and the connection relation is shown in FIG. 4A. One end of the signal source 260 is connected to the metal electrode 240 of the vibrating membrane 230, while the other end of the signal source 260 is connected to the metal electrode 242 of the vibrating membrane 232. To prevent the EMI and/or the risk of electrocution, the utmost perforated electrode structures 210 and 212 are connected to the ground 270 according to this embodiment, such that surplus electric charges in the perforated electrode structures 210 and 212 can enter the ground.

In FIG. 4A, voltages are not yet supplied to the metal electrodes 240 and 242 by the signal source 260, whereas the vibrating membranes 230 and 232 already carry the electric charges. Hence, an attractive force is generated between the positive electric charges of the vibrating membrane 230 and the perforated electrode structure 210 because of the electrostatic effect, and an attractive force is generated between the negative electric charges of the vibrating membrane 232 and the perforated electrode structure 212 because of the electrostatic effect. Thereby, the vibrating membranes 230 and 232 are slightly bent toward the resonance spaces 221 and 223.

Figure 4B:
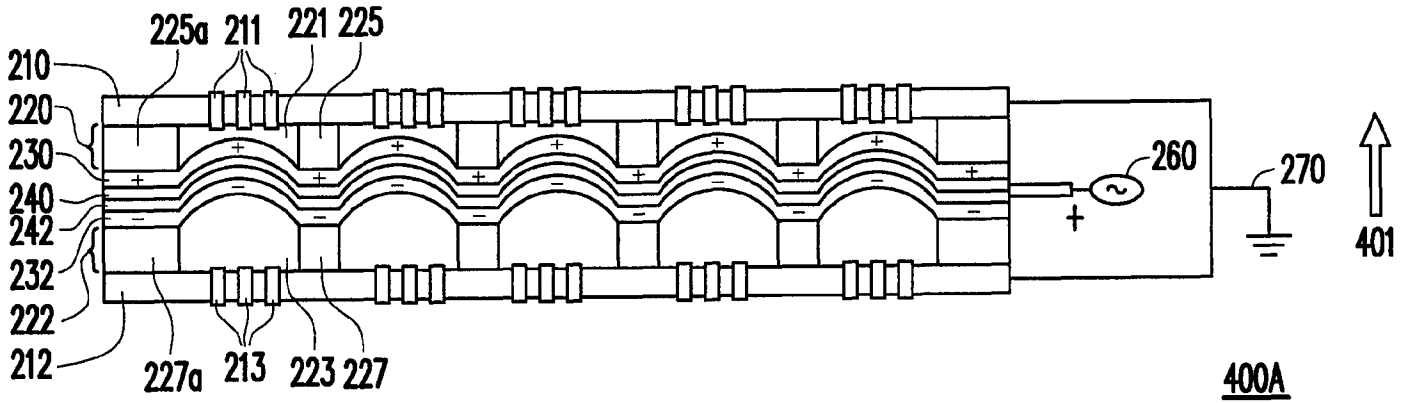

As shown in FIG. 4B, when the positive voltage of the signal source 260 is transmitted to the metal electrode 240, a repulsive force is generated between the positive voltage on the metal electrode 240 and the positive electric charges of the vibrating membrane 230, such that the vibrating membrane 230 is bent toward and compresses the resonance space 221. At the same time, when the positive voltage of the signal source 260 is transmitted to the metal electrode 242, an attractive force is generated between the positive voltage on the metal electrode 242 and the negative electric charges of the vibrating membrane 232, such that the vibrating membrane 232 is bent toward a direction away from the resonance space 223, and that the resonance space 223 is then enlarged. Accordingly, a force-loading direction of the entire vibrating membrane structure is shown as an arrow 401.

Figure 4C:
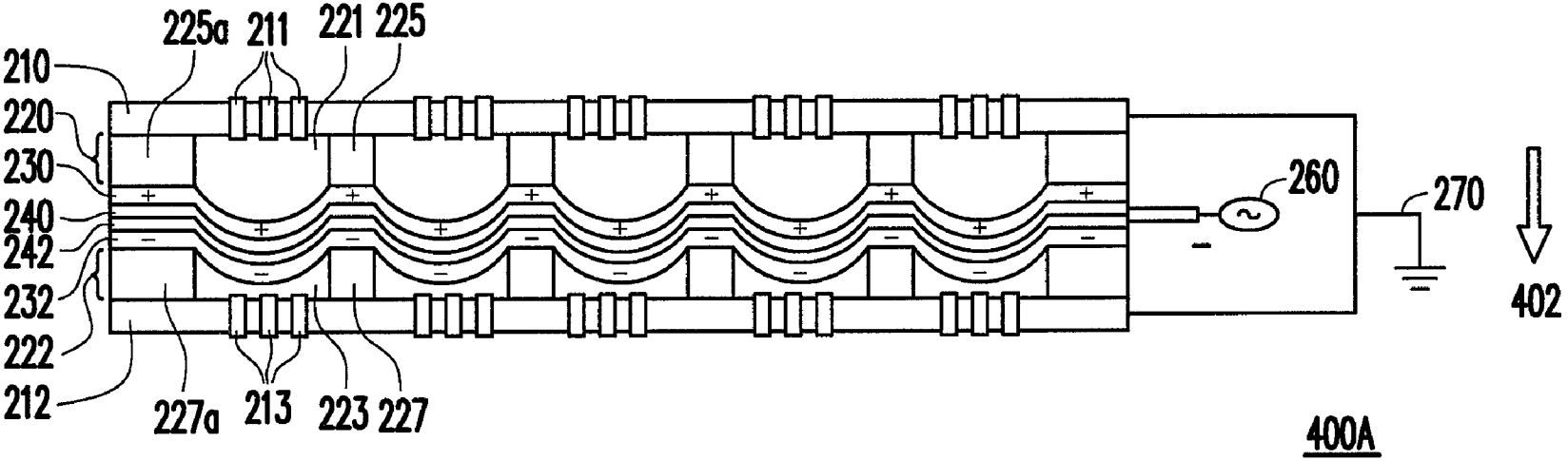

In FIG. 4B, only one phase of the audio signals of the signal source 260 is depicted, which should not be construed as a limitation of the embodiment. For instance, when the phase is reversed, i.e. when the negative voltage of the signal source 260 is transmitted to the metal electrode 240 as shown in FIG. 4C, an attractive force is generated between the negative voltage on the metal electrode 240 and the positive electric charges of the vibrating membrane 230, such that the vibrating membrane 230 is bent toward a direction away from the resonance space 221. By contrast, when the negative voltage of the signal source 260 is transmitted to the metal electrode 242, a repulsive force is generated between the negative voltage on the metal electrode 242 and the negative electric charges of the vibrating membrane 232, such that the vibrating membrane 232 is bent toward and compresses the resonance space 223, and that the resonance space 223 is then reduced. Accordingly, a force-loading direction of the entire vibrating membrane structure is shown as an arrow 402, which is the reverse direction of the arrow 401. The audio signals that have alternate phases and are provided by the signal source 260 allow the flat speaker unit 400A to generate sound at different frequencies or with different volumes due to different force-loading directions of the vibrating membranes.

Based on the above, spacers (e.g. the insulator layer) can be disposed between each of the flat speaker units according to one of embodiments, while the spacers are not required.

Figure 5A:
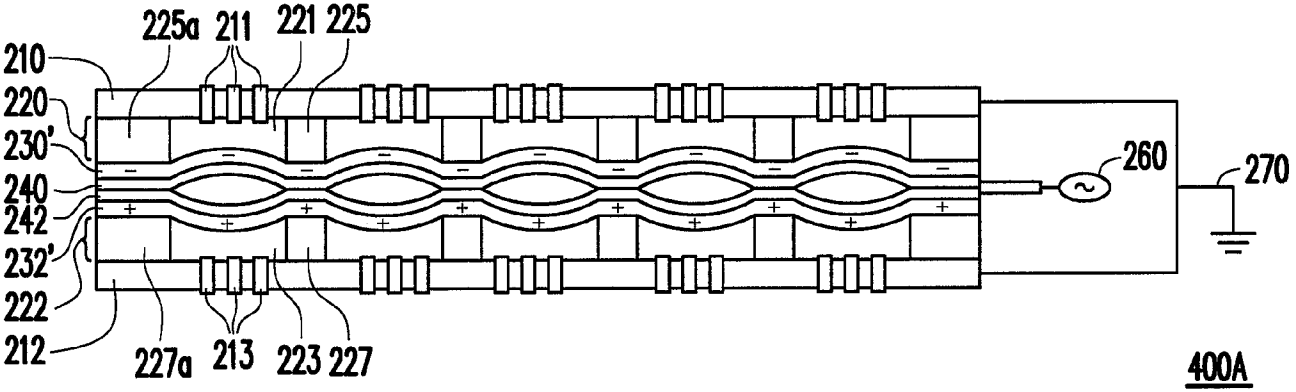
FIGS. 5A to 5C are schematic cross-sectional views illustrating stacked double-layered heteropolar flat speaker units in a loudspeaker structure according to one of embodiments.
Figure 5B:
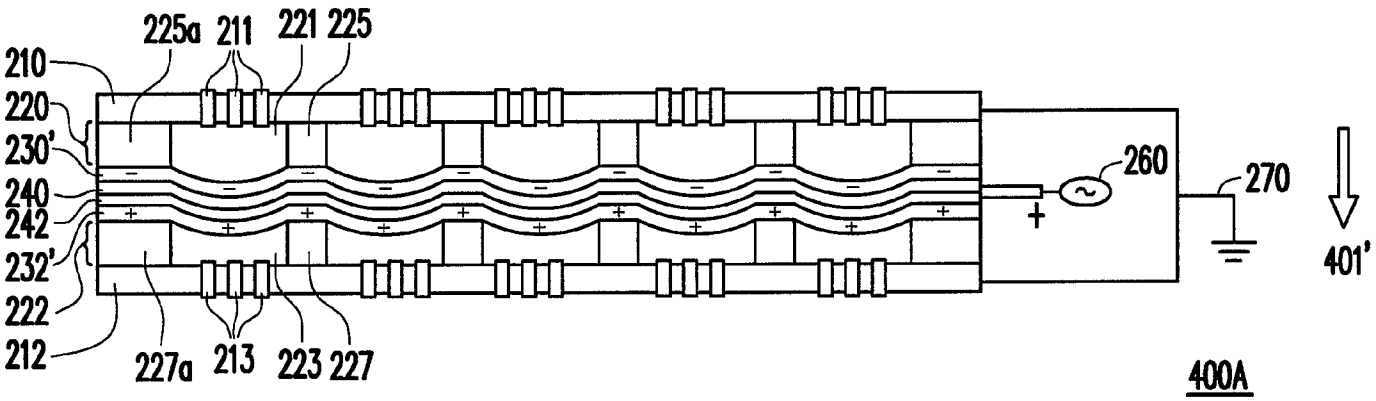
Figure 5C:
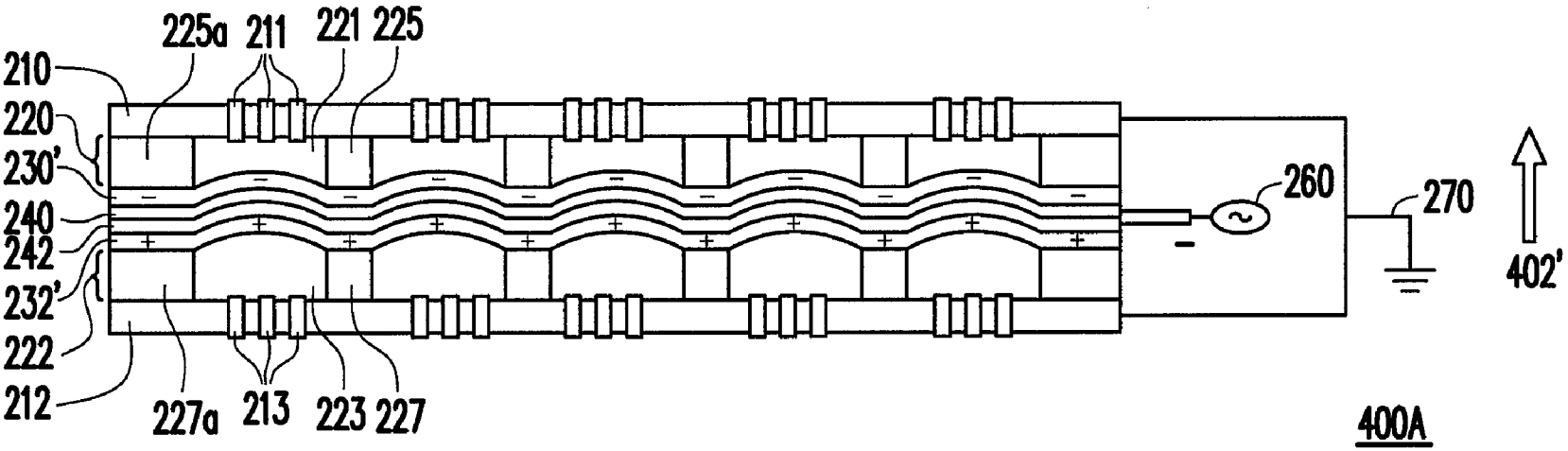

With reference to FIGS. 5A and 5B, in one of embodiments, the vibrating membrane 230 carries the negative electric charges, while the vibrating membrane 232 carries the positive electric charges. When the audio signal having the same phase as described above is input, the force-loading directions of the vibrating membranes in this embodiment are opposite to the force-loading directions of the vibrating membranes in the above embodiment, while other processes remain similar to those mentioned in the previous embodiment. Hence, no further description is provided herein. The force-loading direction of the entire vibrating membrane structure is shown as an arrow 401' in FIG. 5B and as an arrow 402' in FIG. 5C.

Figure 6A:
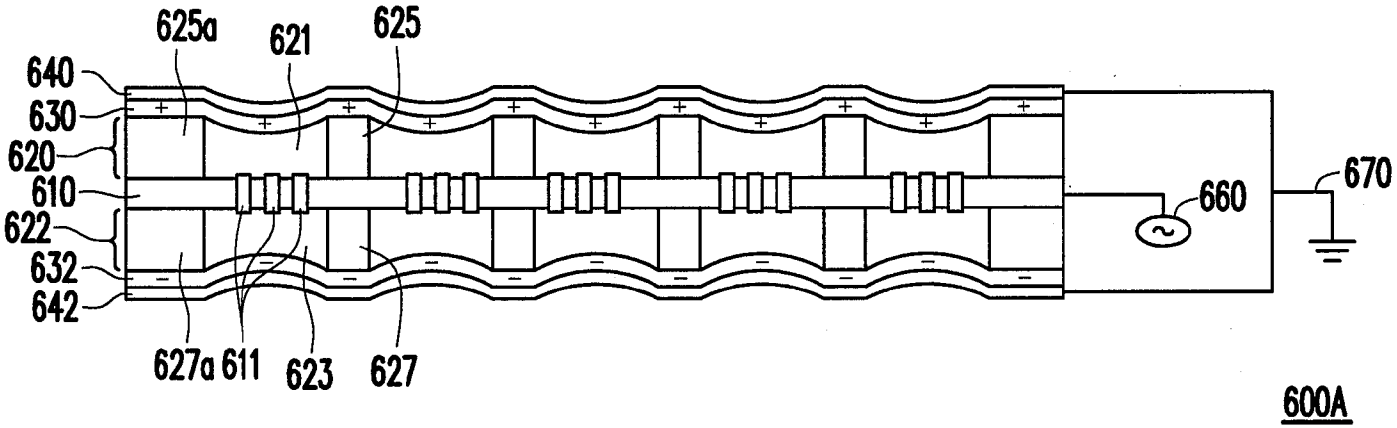
FIGS. 6A to 6C are schematic cross-sectional views illustrating stacked double-layered heteropolar flat speaker units in a loudspeaker structure according to one of embodiments.

Next, please refer to FIG. 6A which illustrates a double-layered flat speaker unit 600A having one perforated electrode structure according to another embodiment. The double-layered flat speaker unit 600A includes upper and lower vibrating membrane structures and a perforated electrode structure stacked together. Each of the vibrating membrane structures includes a vibrating membrane and a conductive electrode, such as the upper vibrating membrane 630 and the metal electrode 640 and the lower vibrating membrane 632 and the metal electrode 642. The two vibrating membrane structures simultaneously correspond to one perforated electrode structure, such as the perforated electrode structure 610 facing the vibrating membranes 630 and 632 as depicted in the drawings. The perforated electrode structure 610 has a plurality of holes (e.g. the depicted holes 611) for circulating air between resonance spaces.

A supporting layer can be selectively disposed between the vibrating membrane structures and the perforated electrode structure 610, so as to support the vibrating membrane structures and form a plurality of operation regions. Thereby, short circuit caused by the contact between the vibrating membranes 630 and 632 and the corresponding perforated electrode structure 610 because of electrostatic effects can be prevented. Additionally, the operation regions can serve as space allowing the vibrating membranes 630 and 632 to oscillate.

The aforesaid supporting layer is, for example, the supporting layer 620 disposed between the vibrating membrane 630 and the perforated electrode structure 610 or the supporting layer 622 disposed between the vibrating membrane 632 and the perforated electrode structure 610. The supporting layer 620 has a frame 625*a* and a plurality of supporting members 625, and the supporting members 625 have different arrangements of patterns. On the other hand, the supporting layer 622 has a frame 627*a* and a plurality of supporting members 627, and the supporting members 627 have different arrangements of patterns. Thereby, resonance spaces 621 and 623 as shown in the drawings are formed.

Here, the supporting members can have a geometrical shape including a rectangular shape, a square shape, a triangular shape, a circular shape, or an elliptical shape. Based on different demands, the pattern layout of the supporting layer can be determined, which is already described in the previous embodiments. Therefore, no further description is given herein.

In this embodiment, the vibrating membranes can be made of an electret piezoelectric material into which positive electric charges or negative electric charges are injected to result in different effects. According to this embodiment, the vibrating membranes 630 and 632 of the flat speaker unit 600A respectively have the positive electric charges and the negative electric charges. Namely, the flat speaker unit 600A has a double-layered heteropolar structure. A signal source 660 is from a single-ended in, single-ended out amplifier for outputting audio signals to the flat loudspeaker structure of the embodiment, and the connection relation is shown in FIG. 6A, i.e. one end of the signal source 660 is connected to the perforated electrode structure 610. At the same time, the metal electrode 640 of the vibrating membrane 630 and the metal electrode 642 of the vibrating membrane 632 are connected to the ground 670, such that surplus electric charges in the metal electrodes 640 and 642 can enter the ground to prevent the EMI and/or the risk of electrocution.

Even though voltages are not yet supplied to the perforated electrode structure 610 by the signal source 660, the vibrating membranes 630 and 632 already carry the electric charges. An attractive force is generated between the positive electric charges of the vibrating membrane 630 and the metal electrode 640 because of the electrostatic effect, and an attractive force is generated between the negative electric charges of the vibrating membrane 632 and the metal electrode 642 because of the electrostatic effect. Thereby, the vibrating membranes 630 and 632 are slightly bent toward the resonance spaces 621 and 623.

Figure 6B:
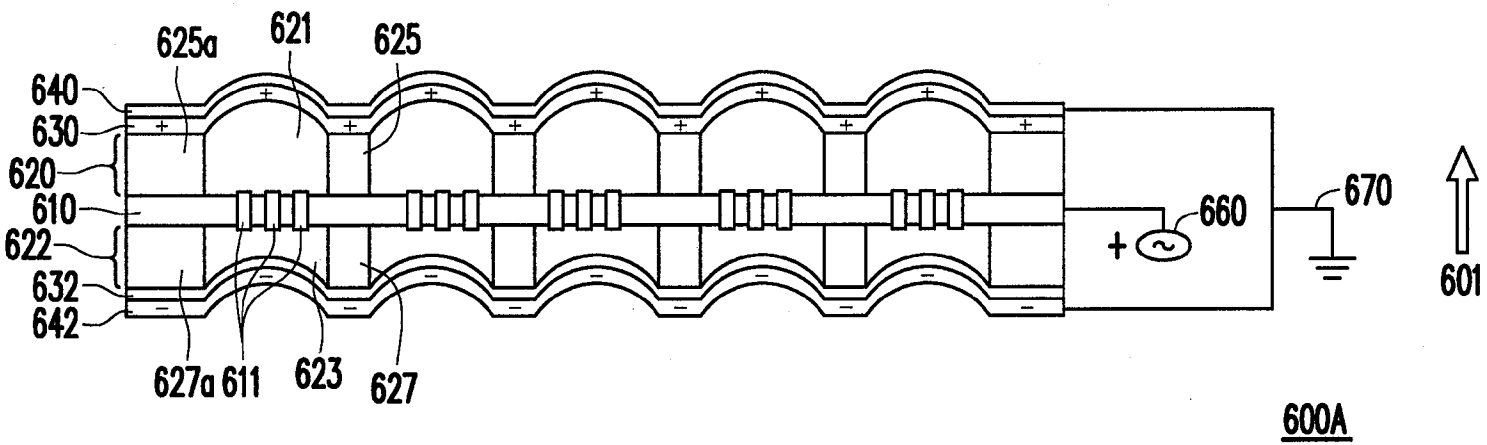

As shown in FIG. 6B, when the positive voltage of the signal source 660 is transmitted to the perforated electrode structure 610, a repulsive force is generated between the positive voltage on the perforated electrode structure 610 and the positive electric charges of the vibrating membrane 630, such that the vibrating membrane 630 is bent toward a direction away from the resonance space 621, and that the resonance space 621 is then enlarged. An attractive force is generated between the positive voltage on the perforated electrode structure 610 and the negative electric charges of the vibrating membrane 632, such that the vibrating membrane 632 is bent toward and compresses the resonance space 623. Accordingly, a force-loading direction of the entire vibrating membrane structure is shown as an arrow 601.

Figure 6C:
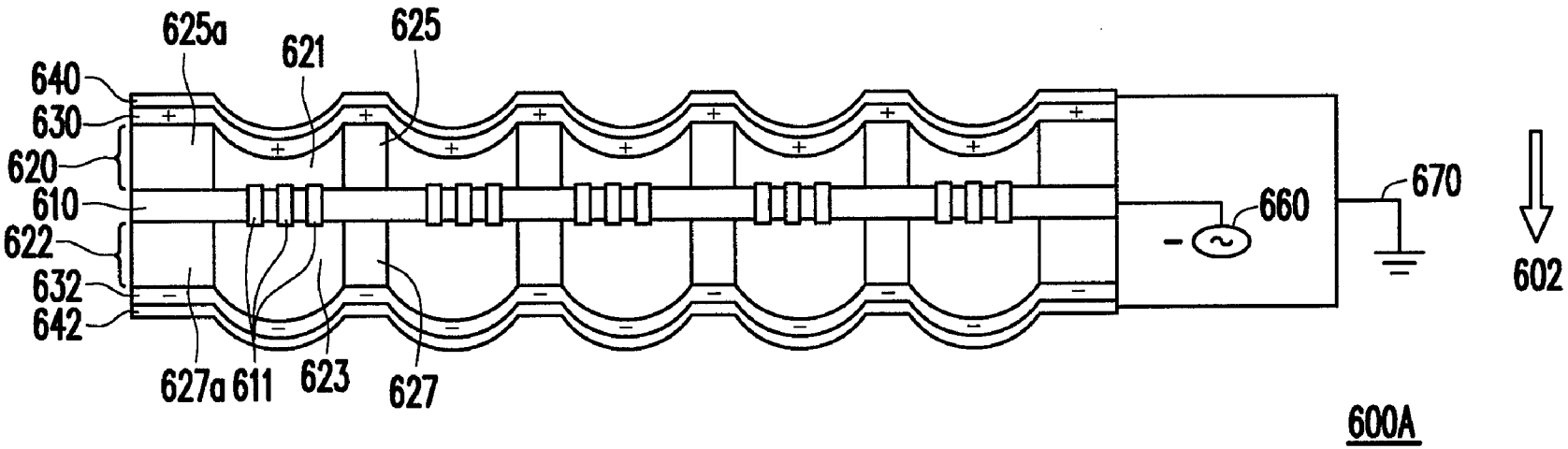

In FIG. 6B, only one phase of the audio signals of the signal source 660 is depicted, which should not be construed as a limitation of the embodiment. For instance, when the phase of the audio signal is reversed, i.e. when the negative voltage of the signal source 660 is transmitted to the perforated electrode structure 610 as shown in FIG. 6C, an attractive force is generated between the negative voltage on the perforated electrode structure 610 and the positive electric charges of the vibrating membrane 630, such that the vibrating membrane 630 is bent toward and compresses the resonance space 621. On the other hand, a repulsive force is generated between the negative voltage on the perforated electrode structure 610 and the negative electric charges of the vibrating membrane 632, such that the vibrating membrane 632 is bent toward a direction away from the resonance space 623, and that the resonance space 623 is then enlarged. Accordingly, a force-loading direction of the entire vibrating membrane structure is shown as an arrow 602.

As stated above, the audio signals that have alternate phases and are provided by the signal source 660 allow the flat speaker unit 600A to generate sound at different frequencies or with different volumes due to different force-loading directions of the vibrating membranes.

Figure 7A:
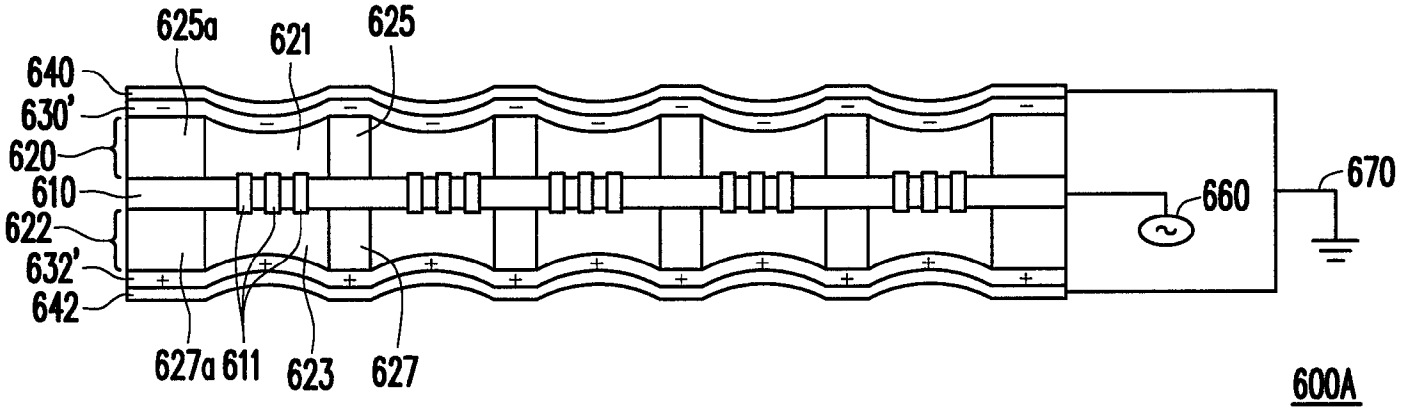
FIGS. 7A to 7C are schematic cross-sectional views illustrating stacked double-layered heteropolar flat speaker units in a loudspeaker structure according to one of embodiments.
Figure 7B:
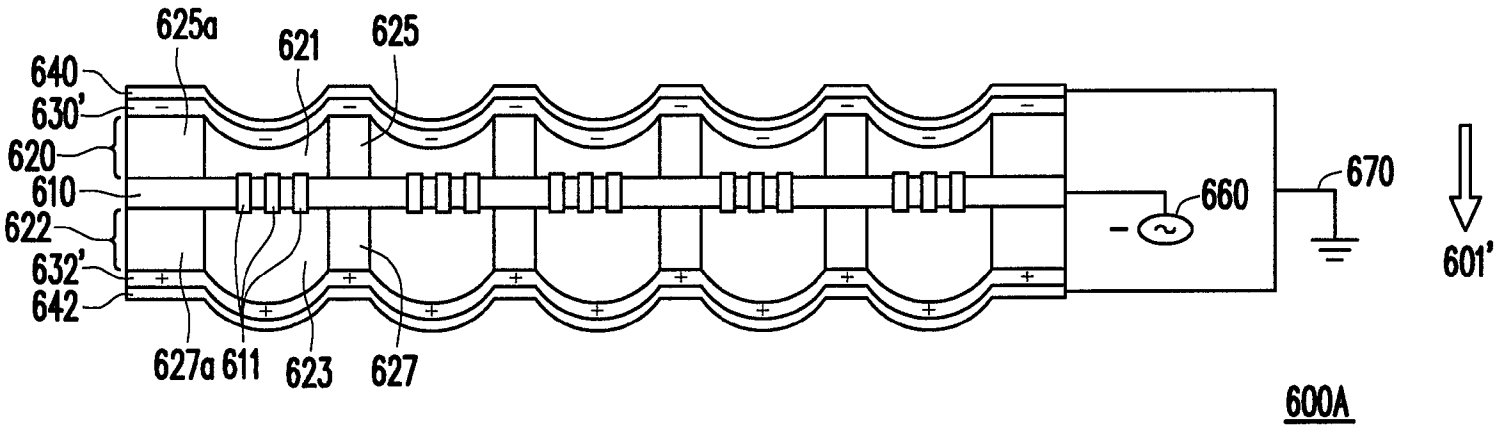
Figure 7C:
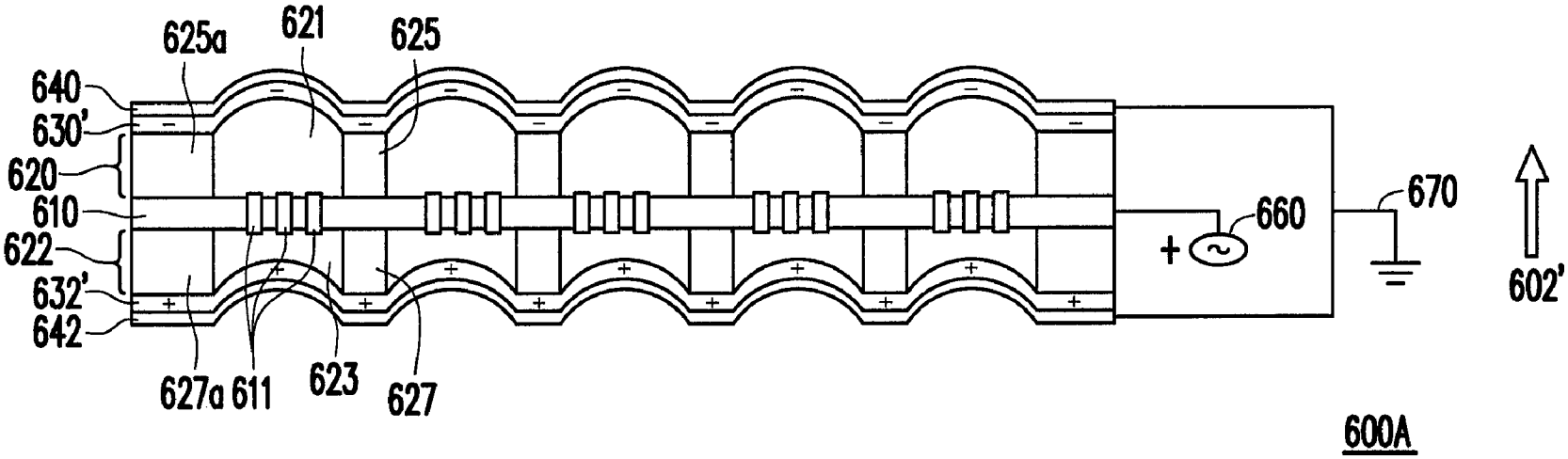

According to one of the embodiments, the double-layered flat speaker unit 600A having one perforated electrode structure as shown in FIG. 7A has the same structure as that depicted in FIG. 6A, whereas the vibrating membrane is made of an electret piezoelectric material into which positive electric charges or negative electric charges are injected to result in different effects. With reference to FIGS. 7B and 7C, in this embodiment, when the audio signal having the same phase as described above is input, the force-loading directions of the vibrating membranes in this embodiment are opposite to the force-loading directions of the vibrating membranes in the above embodiment illustrated in FIGS. 6B and 6C. However, since other processes remain similar to those mentioned in the previous embodiment, no further description is provided herein.

According to the previous embodiments, the double-layered flat speaker units shown in FIGS. 2 to 5 are formed by stacking the assembled vibrating membrane structures. By contrast, in the double-layered flat speaker units shown in FIGS. 6 and 7, the upper and the lower vibrating membrane structures can be completely formed first and then assembled.

The loudspeaker structure in the embodiment can have a variety of assembled flat speaker units as described in the previous embodiments, and the sound generating effects resulting from driving plural sets of flat speaker units can be accomplished by merely adjusting positive and negative polarity ends without changing the design of the signal source.

Different embodiments are provided hereinafter to elaborate the loudspeaker structure formed by stacking plural sets of flat speaker units capable of preventing the EMI according to this embodiment.

Figure 8A:
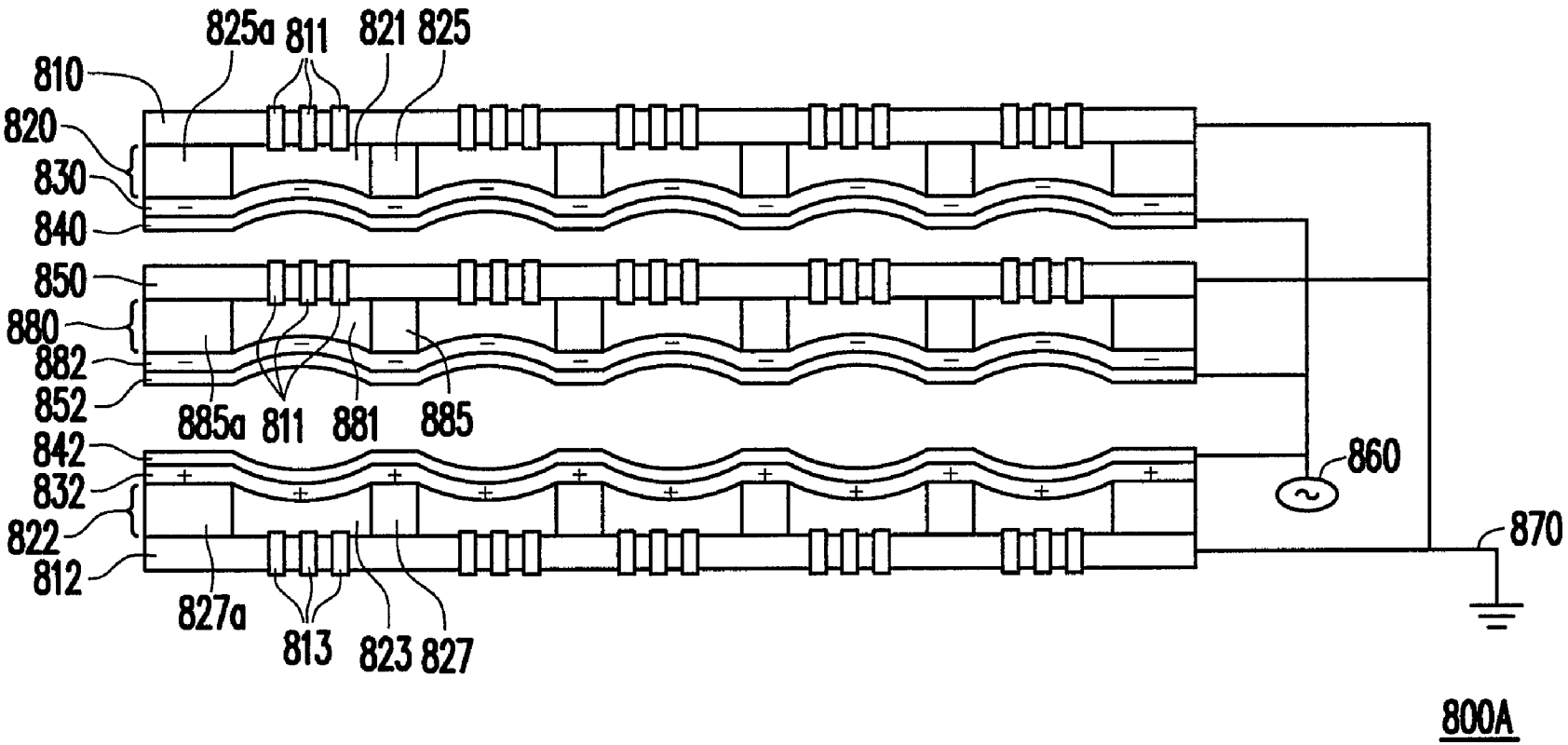
FIGS. 8A to 8C are schematic cross-sectional views illustrating stacked triple-layered heteropolar flat speaker units in a loudspeaker structure according to one of embodiments.

Please refer to FIG. 8A. In this embodiment, three sets of flat speaker units together form the loudspeaker structure. In other words, FIG. 8A illustrates a multi-layered heteropolar flat loudspeaker structure. The stacked structure shown in the drawings includes an upper flat speaker unit having a vibrating membrane structure carrying negative electric charges, a middle flat speaker unit having a vibrating membrane structure carrying negative electric charges, and a lower flat speaker unit having a vibrating membrane structure carrying positive electric charges according to this embodiment. Metal electrodes 840, 852, and 842 of the vibrating membrane structures 830, 882, and 832 in each of the flat speaker units are respectively connected to an audio signal source 860. As stated above, the perforated electrode structures 810, 850, and 812 in each of the speaker units of the flat loudspeaker structure are respectively connected to the ground 870 to prevent the EMI and/or the risk of electrocution. Since electrets in the speaker units are affected by an electrostatic force, the vibrating membrane structures 830, 882, and 832 are slightly bent when the signal source 860 is not applied.

Figure 8B:
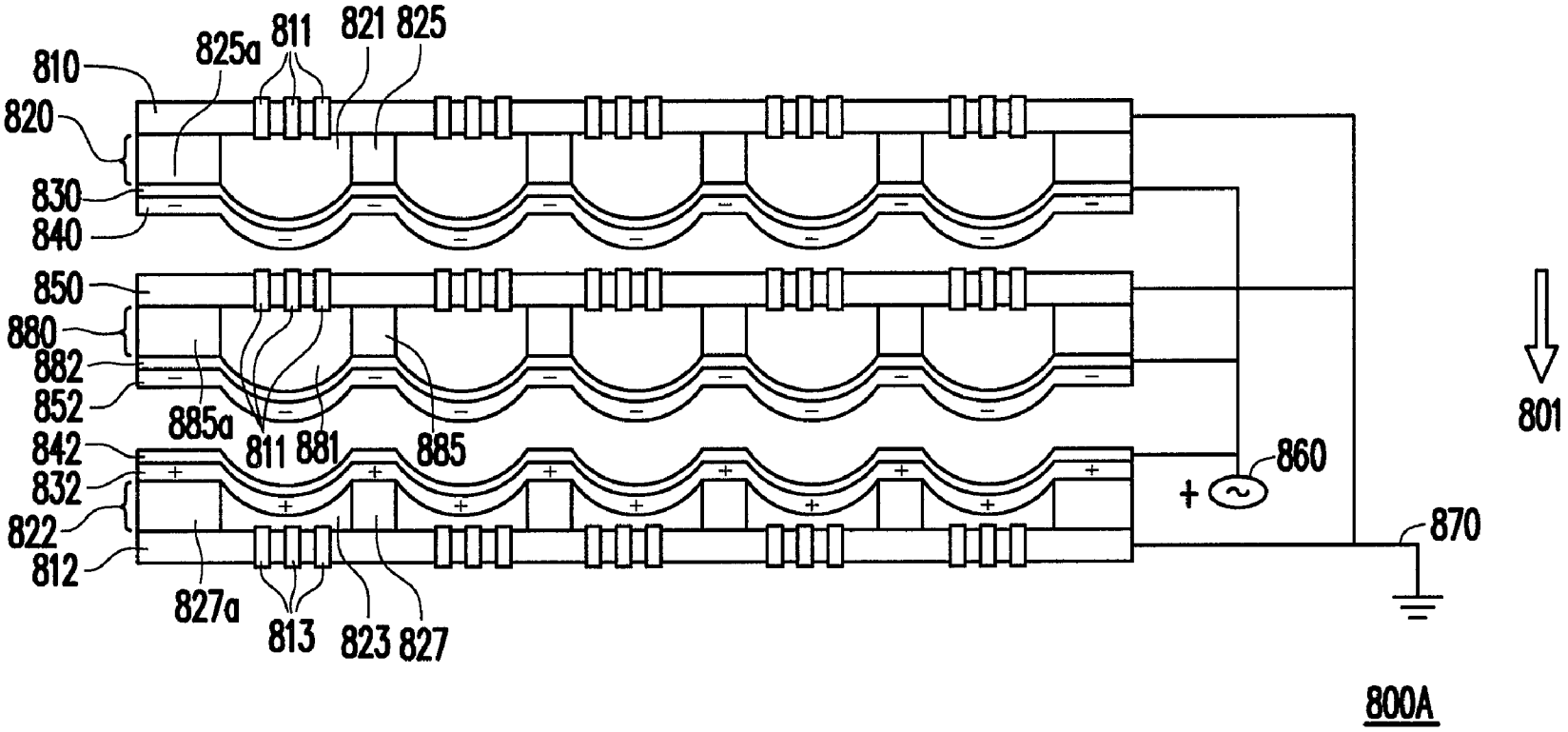
Figure 8C:
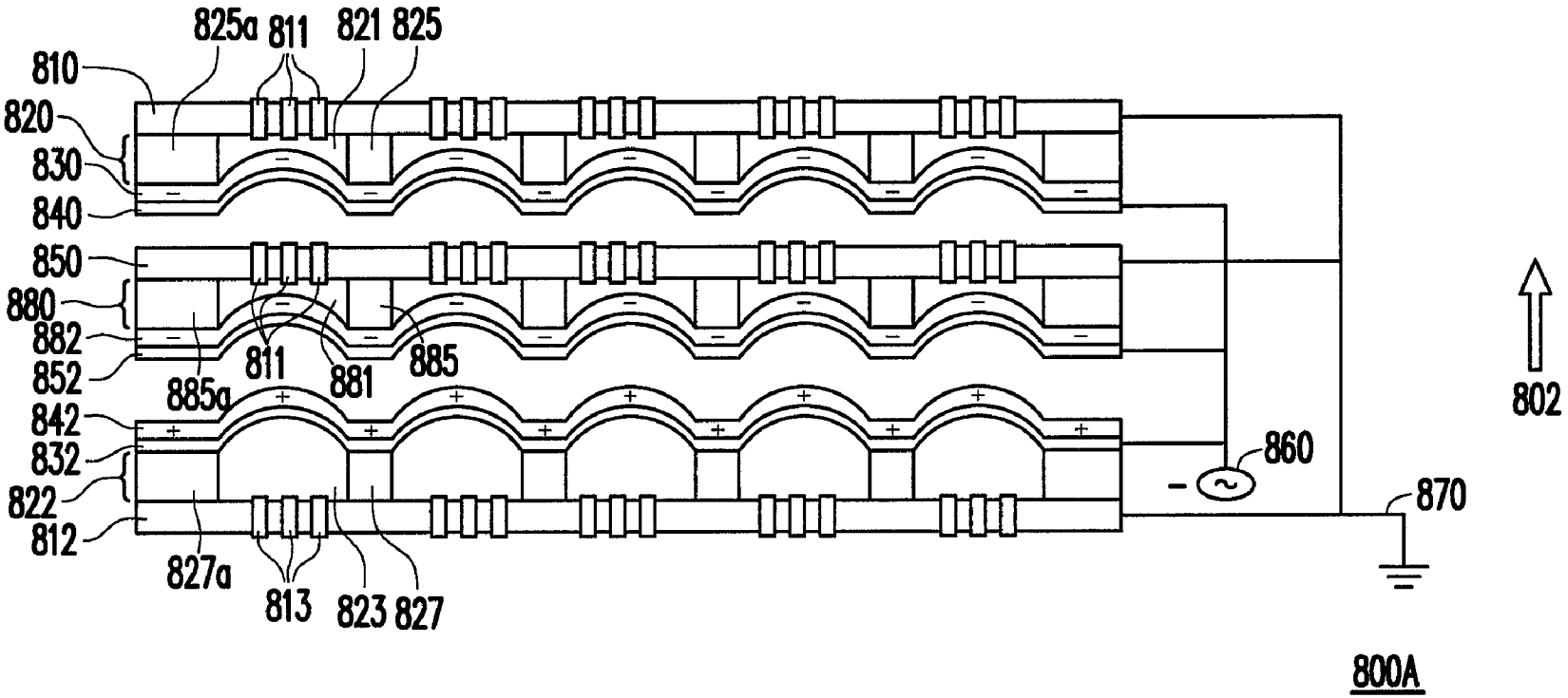

As described above, when the positive voltage is applied by the signal source 860, a force-loading direction of the vibrating membrane structures is shown as an arrow 801 in FIG. 8B. When the polarity of signals supplied by the signal source 806 is inverted, a force-loading direction of the vibrating membrane structures is shown as an arrow 802 in FIG. 8C. The audio signals that have alternate phases and are provided by the signal source 860 allow the loudspeaker structure to generate sound at different frequencies or with different volumes due to different force-loading directions of the vibrating membrane structures.

Figure 9A:
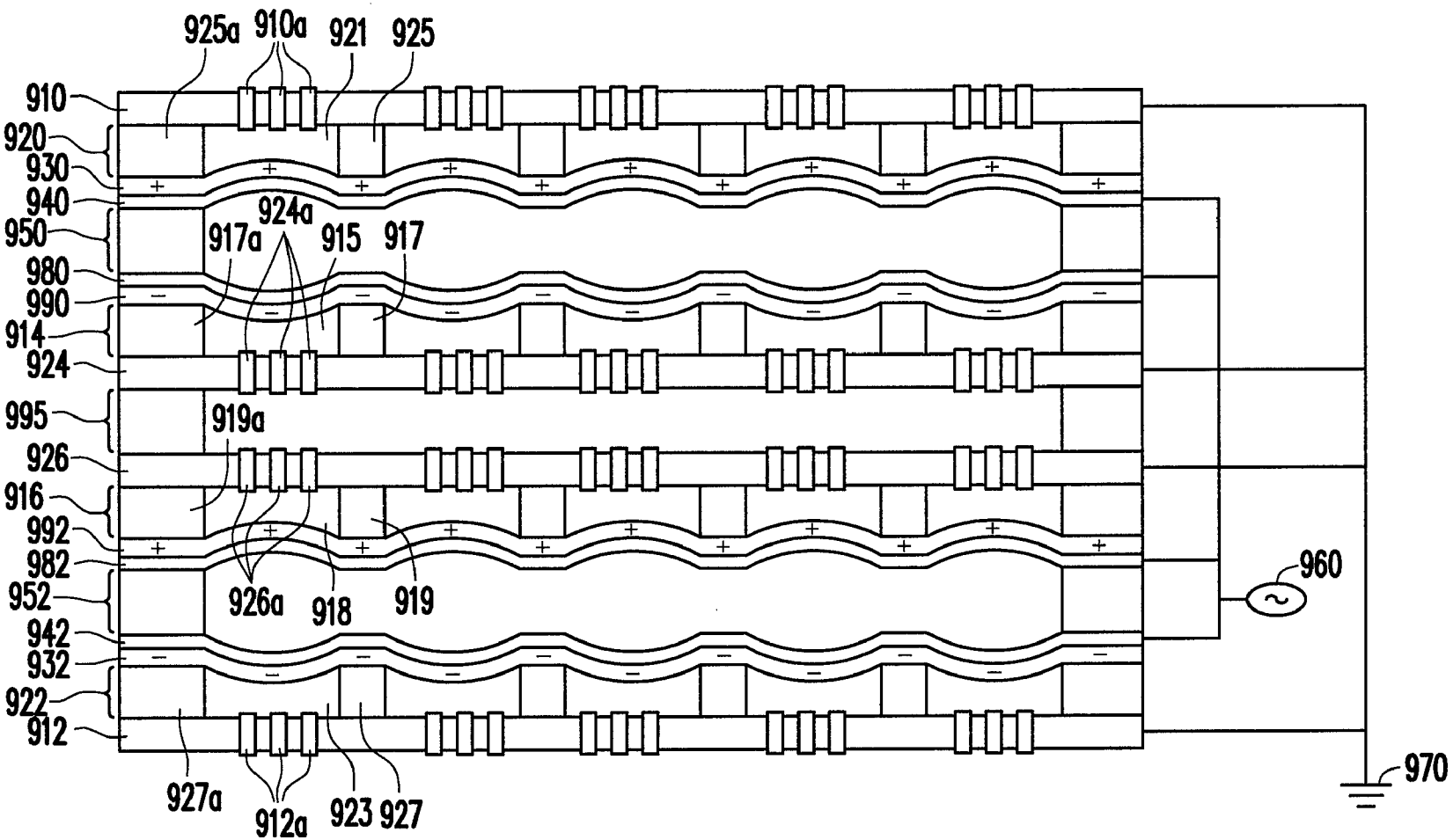
FIGS. 9A to 9F are schematic cross-sectional views illustrating two sets of heteropolar flat speaker units in a loudspeaker structure according to one of embodiments.

In the embodiment shown in FIG. 9A, the flat speaker units 200A depicted in FIG. 2A are employed. Namely, two double-layered heteropolar flat speaker units 200A are stacked together, and an insulator layer is disposed therebetween. A signal source 960 is connected to metal electrodes 940, 980, 982, and 942 of the vibrating membrane structures 930, 990, 992, and 932 in each of the flat speaker units 200A. The perforated electrode structures 910, 924, 926, and 912 in each of the speaker units 200A of the flat loudspeaker structure are respectively connected to the ground 970 to prevent the EMI and the risk of electrocution. Since electrets in the speaker units are affected by an electrostatic force, the vibrating membrane structures 930, 990, 992, and 932 are slightly bent when the signal source 960 is not applied.

Figure 9B:
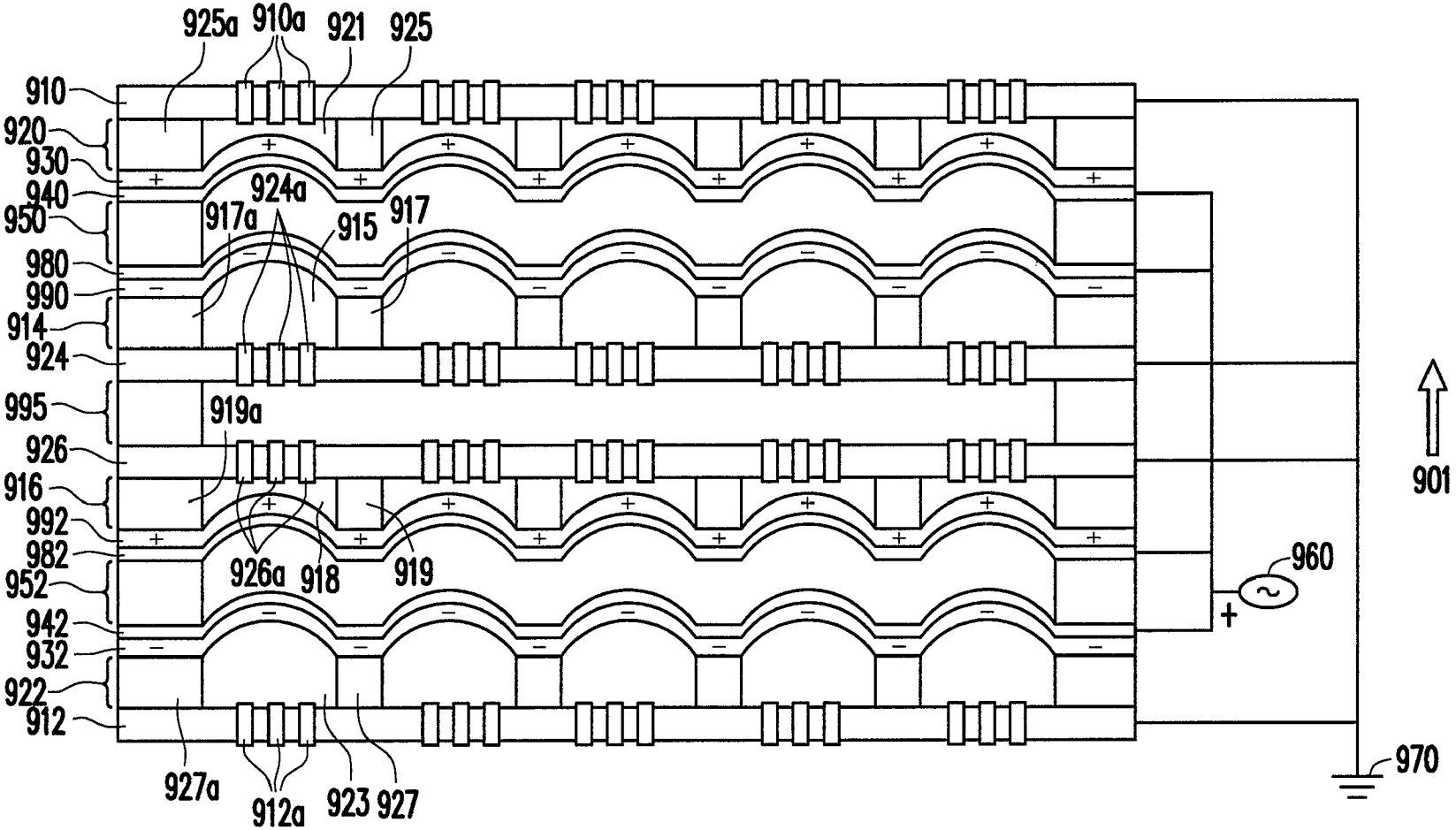
Figure 9C:
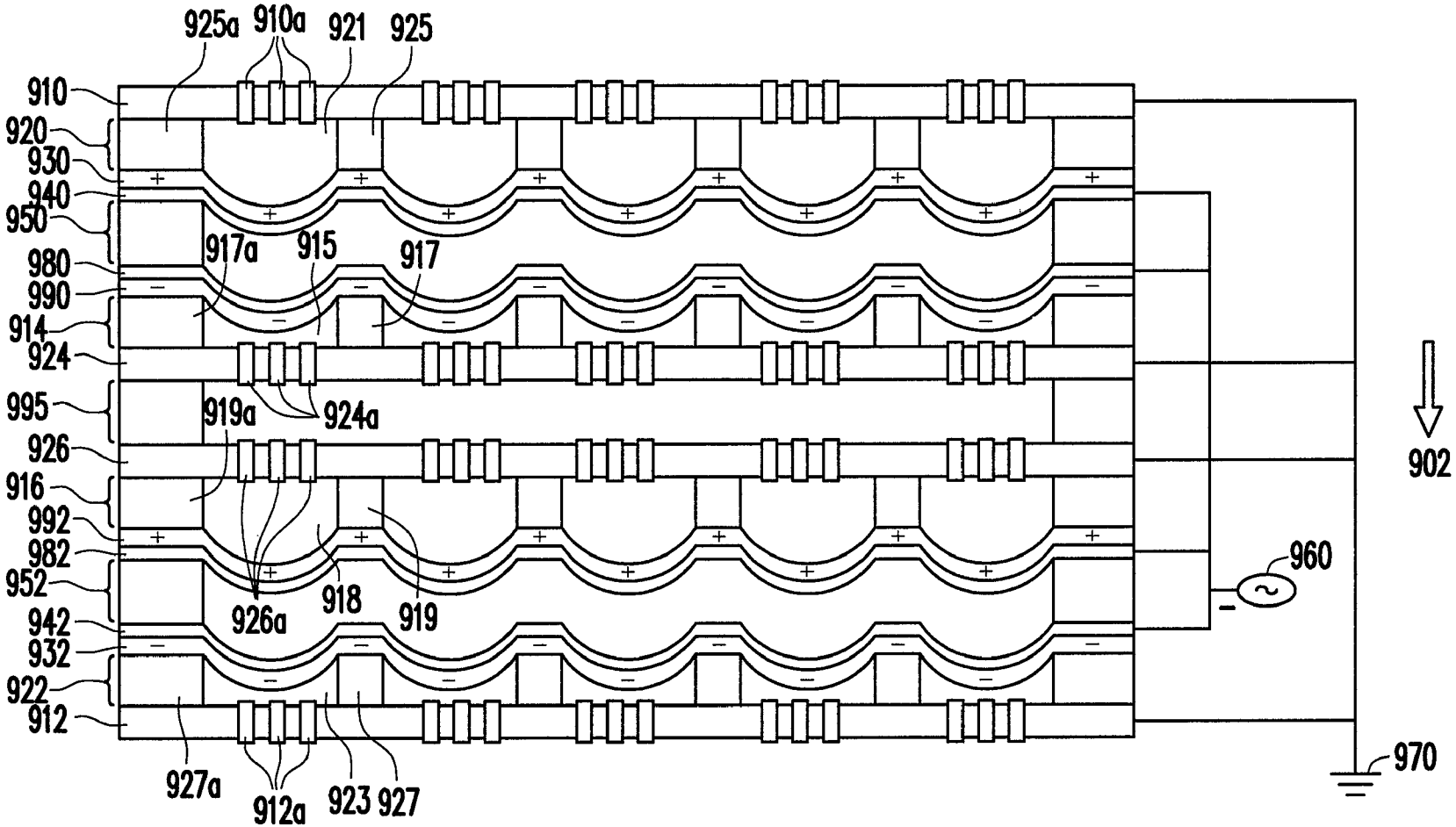

As described above, when the positive voltage is applied by the signal source 960, a force-loading direction of the vibrating membrane structures is shown as an arrow 901 in FIG. 9B. When the polarity of signals supplied by the signal source 960 is inverted, a force-loading direction of the vibrating membrane structures is shown as an arrow 902 in FIG. 9C. That is to say, the audio signals that have alternate phases and are provided by the signal source 960 allow the loudspeaker structure to generate sound at different frequencies or with different volumes due to different force-loading directions of the vibrating membrane structures.

Figure 9D:
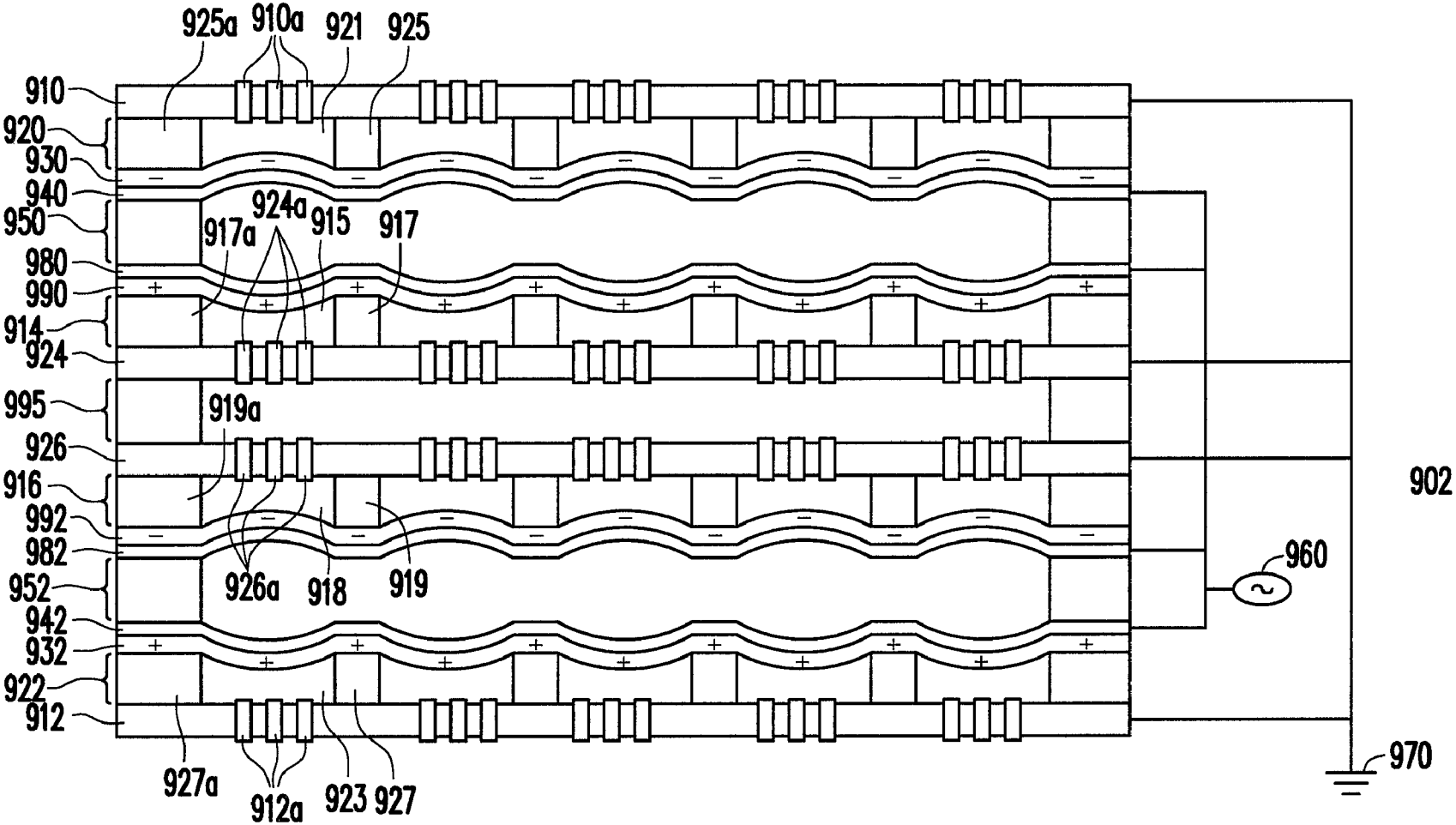
Figure 9E:
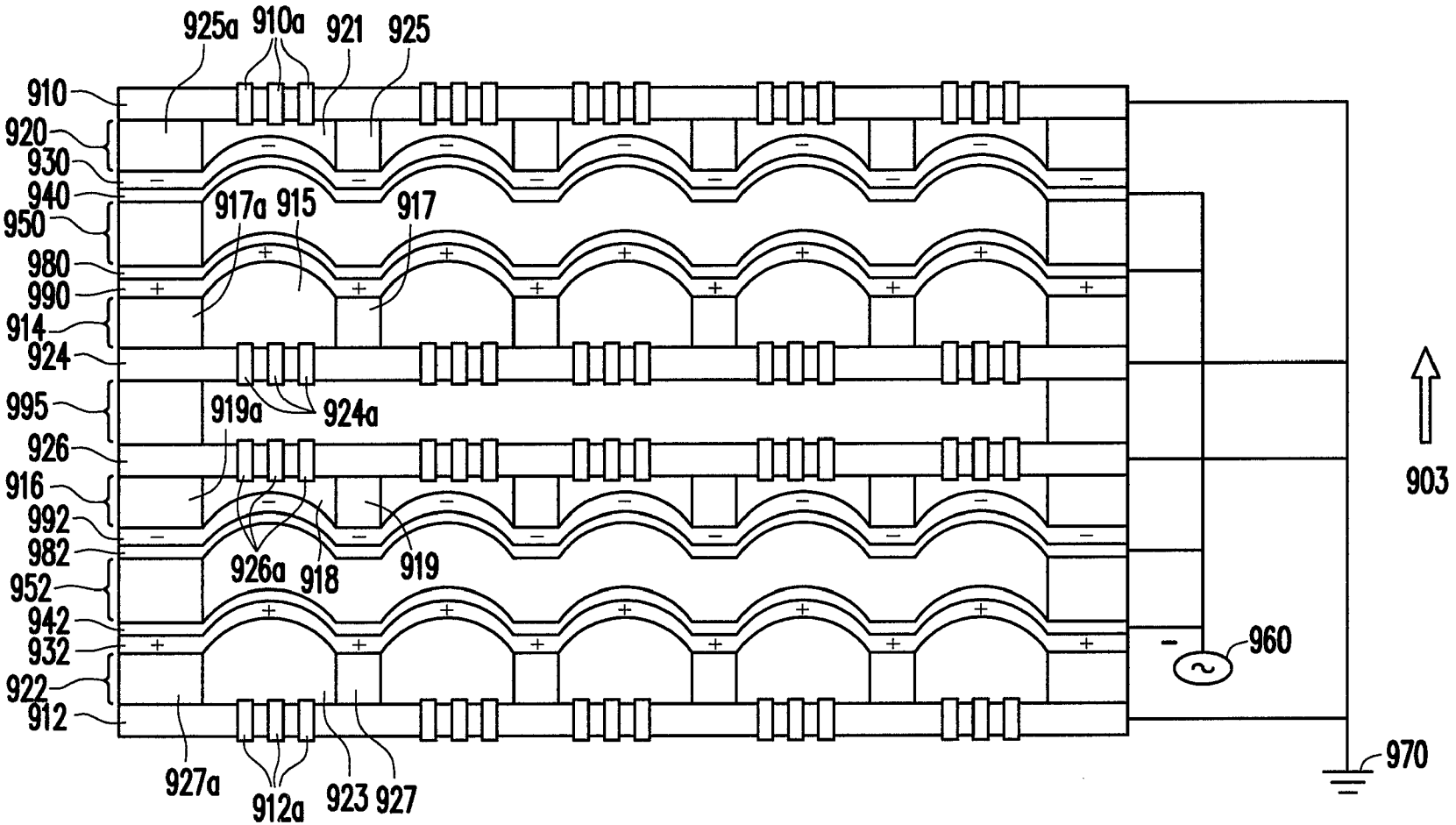
Figure 9F:
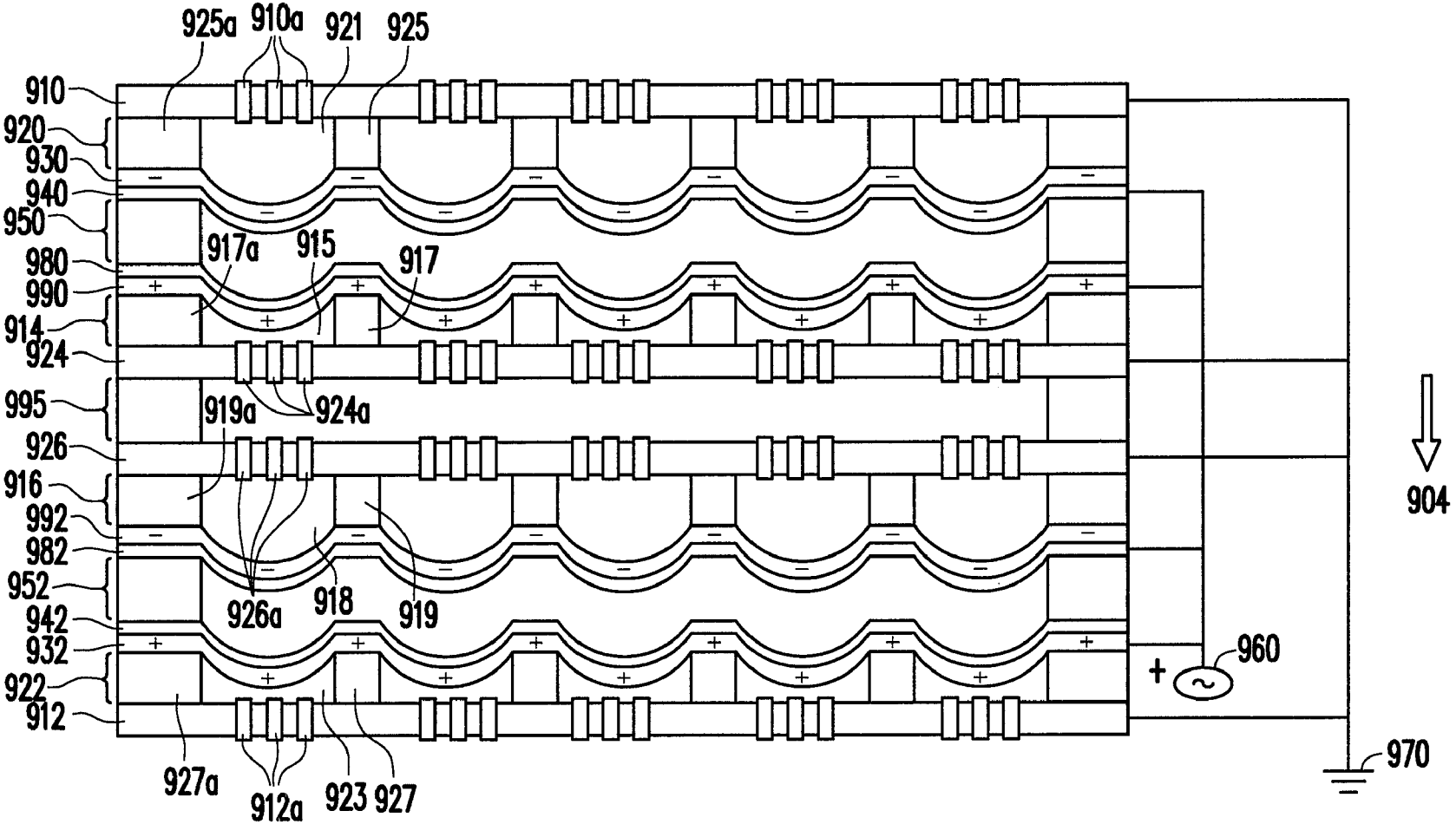

In one of the embodiments, the vibrating membrane structures 930 and 992 carry the negative electric charges, while the vibrating membrane structures 990 and 932 carry the positive electric charges. With reference to FIGS. 9D to 9F, in this embodiment, the electrets in the speaker units are affected by an electrostatic force. Therefore, the vibrating membrane structures 930, 990, 992, and 932 are slightly bent when the signal source 960 is not applied. As described above, when the negative voltage is applied by the signal source 960 (as indicated in FIG. 9E), a force-loading direction of the vibrating membrane structures is shown as an arrow 903. When the polarity of signals supplied by the signal source 960 is inverted, a force-loading direction of the vibrating membrane structures is shown as an arrow 904 in FIG. 9F. That is to say, the audio signals that have alternate phases and are provided by the signal source 960 allow the loudspeaker structure to generate sound at different frequencies or with different volumes due to different force-loading directions of the vibrating membrane structures.

Based on the above-mentioned designs, the flat speaker units can be assembled without complex circuits in order to comply with sound pressure standards of products. Through supplying one set of external audio signals and applying an audio signal input design, the output volume can be increased. Note that the flat loudspeaker structure of the embodiment can include an even number of flat speaker units or an odd number of flat speaker units. Besides, the electrodes with the same polarity can contact one another, or consecutive or inconsecutive spacers can be disposed among the electrodes. Regardless of the number of the stacked flat speaker units, the utmost electrodes of the multi-layered flat loudspeaker structure must be grounded. The above embodiments merely demonstrate partial applications of the embodiment. The loudspeaker structure capable of preventing the EMI in this embodiment can have the flat speaker units assembled in various ways without being limited in this embodiment. Different combinations of the flat speaker units do not depart from the scope of the embodiment.

Single-ended In/Differential Out Double-layered Homopolar Flat Speaker Unit

Figure 10:
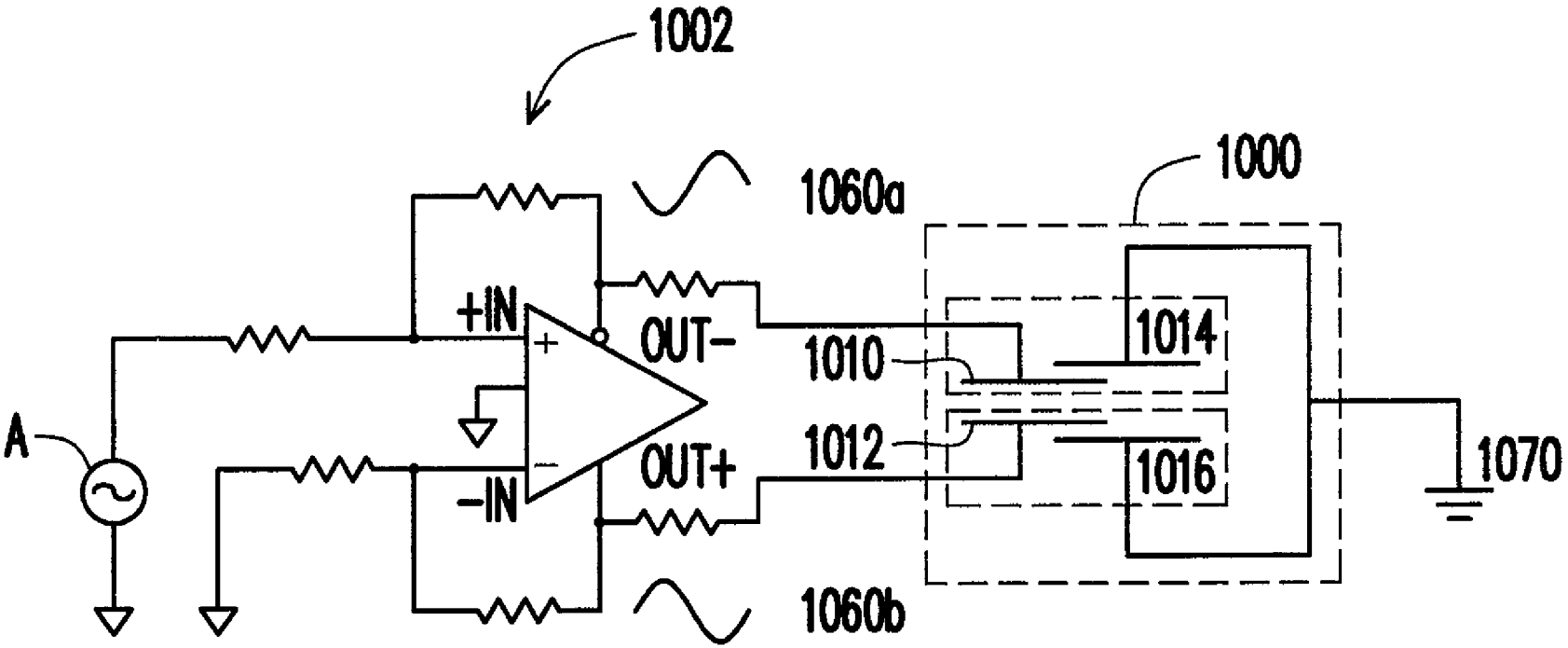
FIG. 10 is a schematic view illustrating a signal source amplified by a single-ended in, differential-out amplifier.

In other embodiments, a signal source can be amplified by a single-ended in, differential out (single-in differential-out) amplifier as shown in FIG. 10. That is to say, audio signals with two opposite phases can be simultaneously output. A multi-layered loudspeaker structure can be formed by the flat speaker units with the same polarity, which is explained below.

In FIG. 10, a signal source A is amplified by a single-ended in, differential out amplifier 1002, and then audio signals 1060*a* and 1060*b* with opposite phases are output in a differential-out manner. At this time, voltages of the audio signals 1060*a* and 1060*b* are respectively transmitted to metal electrodes 1010 and 1012 in a flat loudspeaker structure 1000, and electrodes 1014 and 1016 are connected to a ground level 1070 to prevent the EMI and the risk of electrocution.

Figure 11A:
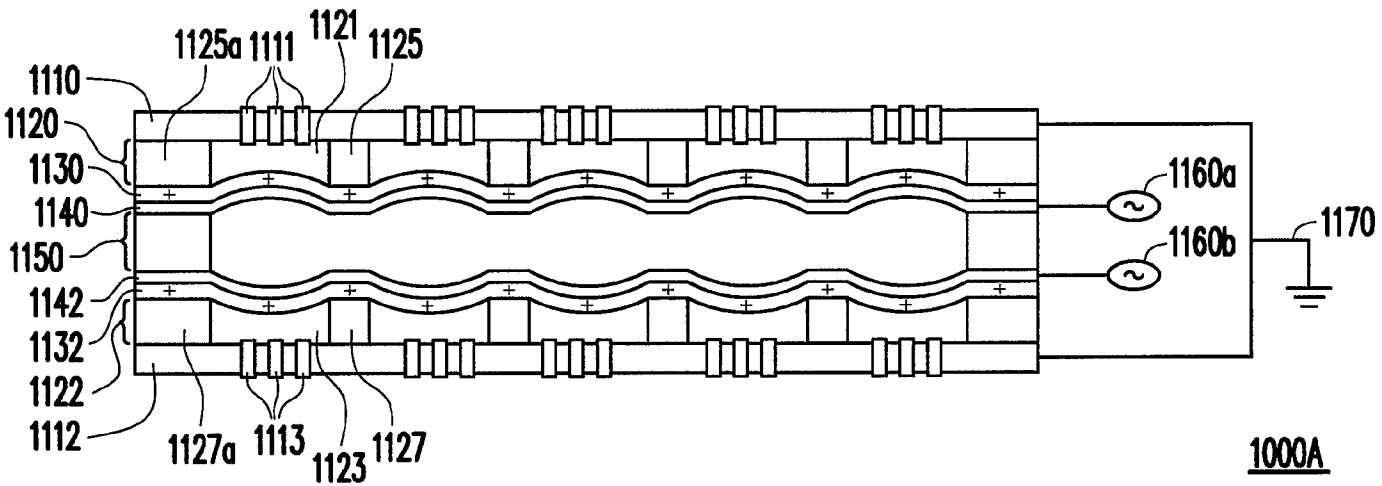
FIGS. 11A to 11C are schematic cross-sectional views illustrating a double-layered homopolar differential-out flat speaker unit in a flat loudspeaker structure according to one of embodiments.

Please refer to FIG. 11A which is a schematic cross-sectional view illustrating flat speaker units in a double-layered flat loudspeaker structure according to an embodiment. In this embodiment, the single-ended in, differential out amplifier is used, and a vibrating membrane material having a conductive electrode layer (e.g. a metal electrode) is disposed in the double-layered flat speaker unit. A perforated electrode structure is disposed at two utmost sides of the speaker unit and grounded to prevent the EMI and protect a user from contacting high voltages.

The flat speaker unit 1000A is formed by stacking upper and lower vibrating membrane structures and the perforated electrode structure, and an insulator layer 1150 is disposed therebetween for electrical insulation. Each of the vibrating membrane structures has a corresponding perforated electrode structure located at the utmost side of the flat speaker unit 1000A, such as the perforated electrode structure 1110 facing the vibrating membrane 1130 and the perforated electrode structure 1112 facing the vibrating membrane 1132. The perforated electrode structures 1110 and 1112 respectively have a plurality of holes (e.g. the depicted holes 1111 and 1113) for circulating air between resonance spaces. Each of the vibrating membrane structures includes an electret vibrating membrane and a conductive electrode thereof, such as the upper vibrating membrane 1130 and the metal electrode 1140 and the lower vibrating membrane 1132 and the metal electrode 1142. The vibrating membrane in the embodiments can be the electret vibrating membrane or a vibrating membrane made of other materials. The embodiment covers modifications and variations of the vibrating membrane as long as the vibrating membrane is capable of outputting sound.

A supporting layer can be selectively disposed between each vibrating membrane structure and the corresponding perforated electrode structure, so as to support the vibrating membrane structure and form a plurality of operation regions. Thereby, short circuit caused by the contact between the vibrating membranes 1130 and 1132 and the corresponding perforated electrode structures 1110 and 1112 because of electrostatic effects can be prevented. Additionally, the operation regions can serve as space allowing the vibrating membranes 1130 and 1132 to oscillate. The aforesaid supporting layer is, for example, the supporting layer 1120 disposed between the vibrating membrane 1130 and the perforated electrode structure 1110 or the supporting layer 1122 disposed between the vibrating membrane 1132 and the perforated electrode structure 1112. The supporting layer 1120 has a frame 1125*a* and a plurality of supporting members 1125, and the supporting members 1125 have different arrangements of patterns. On the other hand, the supporting layer 1122 has a frame 1127*a* and a plurality of supporting members 1127, and the supporting members 1127 have different arrangements of patterns. Thereby, resonance spaces 1121 and 1123 as shown in the drawings are formed. As described above, the frame 1125*a* or 1127*a* of the supporting layer 1120 or 1122 can have any geometrical shape, and the arrangement of patterns of the supporting layer 1120 or 1122 can be in any shape based on different demands. Thus, no further description is given herein.

According to this embodiment, the vibrating membranes 1130 and 1132 of the flat speaker unit 1000A have homopolar electric charges. As shown in the drawings, the vibrating membranes 1130 and 1132 both have the positive electric charges. The connection relation of the signal sources 1160*a* and 1160*b* which provide the audio signals is shown in FIG. 11A. The signal source 1160*a* is connected to the metal electrode 1140 of the vibrating membrane 1130, and the signal source 1160*b* is connected to the metal electrode 1142 of the vibrating membrane 1132. The utmost perforated electrode structures 1110 and 1112 are connected to the ground 1170 to, for example, prevent the EMI and/or the risk of electrocution, such that the electric charges in the perforated electrode structures 1110 and 1112 can enter the ground.

In FIG. 11A, voltages are not yet supplied to the metal electrodes 1140 and 1142 by the signal sources 1160*a* and 1160*b*, whereas an electrostatic force is already applied to the vibrating membranes 1130 and 1132. Hence, an attractive force is generated between the positive electric charges of the vibrating membranes 1130 and 1132 and the negative electric charges of the perforated electrode structures 1110 and 1112. Thereby, the vibrating membranes 1130 and 1132 are slightly bent toward the resonance spaces 1121 and 1123.

Figure 11B:
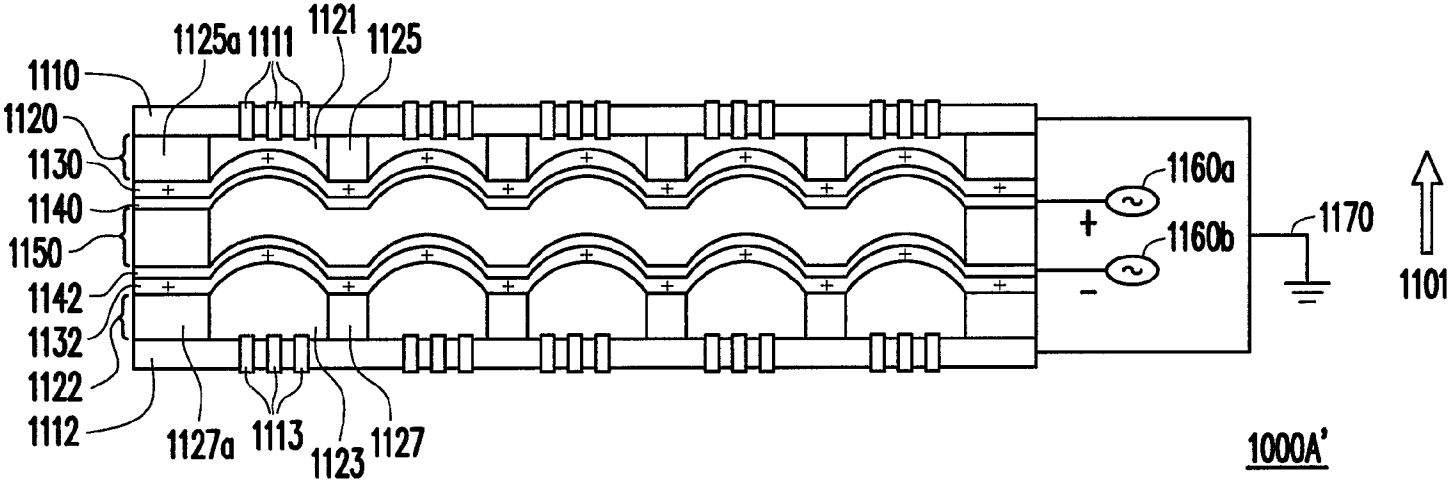

As shown in FIG. 11B, when the positive voltage of the signal source 1160*a* is transmitted to the metal electrode 1140, a repulsive force is generated between the positive voltage on the metal electrode 1140 and the positive electric charges of the vibrating membrane 1130, such that the vibrating membrane 1130 is bent toward and compresses the resonance space 1121. On the other hand, when the negative voltage of the signal source 1160*b* is transmitted to the metal electrode 1142, an attractive force is generated between the negative voltage on the metal electrode 1142 and the positive electric charges of the vibrating membrane 1132, such that the vibrating membrane 1132 is bent toward a direction away from the resonance space 1123, and that the resonance space 1123 is then enlarged. Accordingly, a force-loading direction of the entire vibrating membrane structure is shown as an arrow 1101.

In FIG. 11B, one differential phase of the audio signals of the signal sources 1160*a* and 1160*b* is depicted, which should not be construed as a limitation of the embodiment. For instance, when the phases of the signal sources 1160*a* and 1160*b* are opposite, i.e. when the negative voltage of the signal source 1160*a* is transmitted to the metal electrode 1140 of the vibrating membrane 1130, and the positive voltage of the signal source 1160*b* is transmitted to the metal electrode 1142 of the vibrating membrane 1132, a force-loading direction of the entire vibrating membrane structure is shown as a reverse direction of the arrow 1101.

Figure 11C:
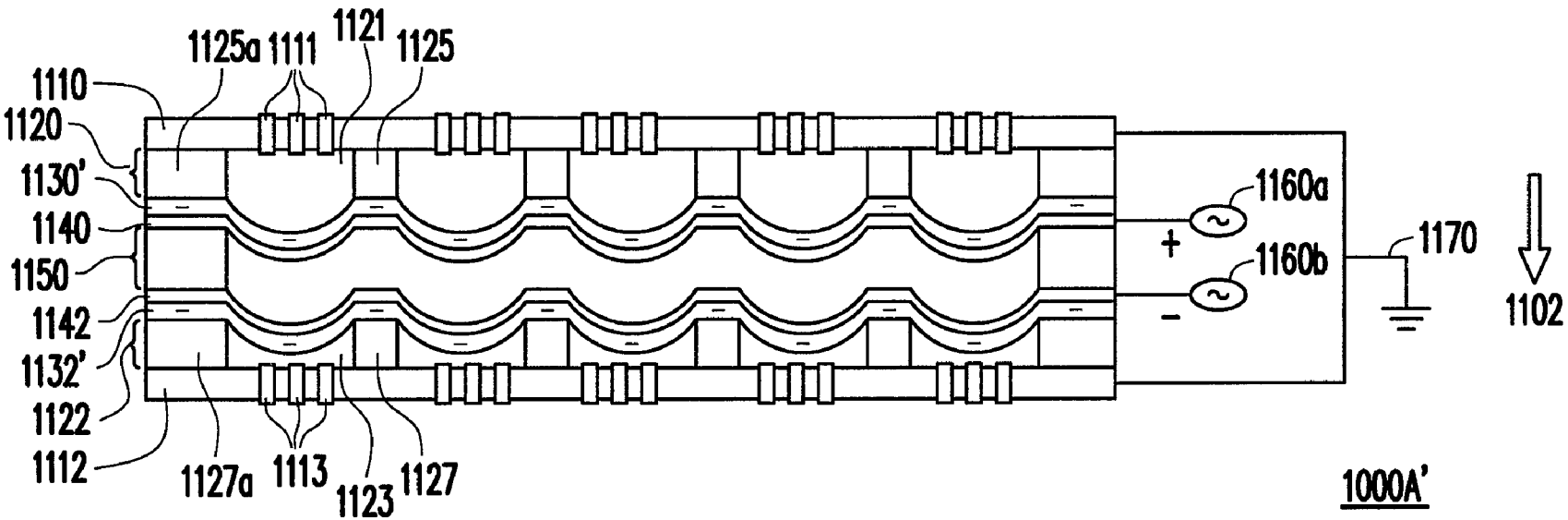

In the above embodiment, the vibrating membranes 1130 and 1132 can together carry the negative electric charges. Please refer to FIG. 11C. FIG. 11C is a schematic cross-sectional view illustrating a flat speaker unit 1000A' in the double-layered flat loudspeaker structure having negative polarity. The structure of the flat speaker unit 1000A' is similar to the flat speaker unit 1000A. Thus, same components of the flat speaker unit 1000A' and the flat speaker unit 1000A are labeled by the same reference numbers, and no further descriptions are provided herein.

The difference therebetween lies in that the vibrating membranes 1130' and 1132' carry positive electric charges. The connection relation of the signal sources 1160*a* and 1160*b* which provide the audio signals is shown in FIG. 11B. When the positive voltage of the signal source 1160*a* is transmitted to the metal electrode 1140, an attractive force is generated between the positive voltage on the metal electrode 1140 and the negative electric charges of the vibrating membrane 1130', such that the vibrating membrane 1130' is bent toward a direction away from the resonance space 1121, and that the resonance space 1121 is then enlarged. On the other hand, when the negative voltage of the signal source 1160*b* is transmitted to the metal electrode 1142, a repulsive force is generated between the negative voltage on the metal electrode 1142 and the negative electric charges of the vibrating membrane 1132', such that the vibrating membrane 1132' is bent toward and compresses the resonance space 1123. Accordingly, a force-loading direction of the entire vibrating membrane structure is shown as an arrow 1102.

In FIG. 11C, one differential phase of the audio signals of the signal sources 1160*a* and 1160*b* is depicted, which should not be construed as a limitation of the embodiment. For instance, when the phases of the signal sources 1160*a* and 1160*b* are opposite, i.e. when the negative voltage of the signal source 1160*a* is transmitted to the metal electrode 1140 of the vibrating membrane 1130', and the positive voltage of the signal source 1160*b* is transmitted to the metal electrode 1142 of the vibrating membrane 1132', a force-loading direction of the entire vibrating membrane structure is shown as a reverse direction of the arrow 1101. The audio signals that have alternate phases and are provided by the signal sources 1160*a* and 1160*b* allow the flat speaker unit 1000A' to generate sound at different frequencies or with different volumes due to different force-loading directions of the vibrating membranes.

In FIG. 12, the flat speaker unit 1200A of this embodiment is formed by stacking upper and lower vibrating membrane structures, and an insulator layer 1295 is disposed therebetween for electrical insulation. The two membrane structures are respectively homopolar and heteropolar. Each of the vibrating membrane structures has a corresponding perforated electrode structure located at the utmost side of the flat speaker unit 1200A, such as the perforated electrode structure 1210 facing the vibrating membrane 1230 and the perforated electrode structure 1212 facing the vibrating membrane 1232. The perforated electrode structures 1210 and 1212 respectively have a plurality of holes (e.g. the depicted holes 1212*a* and 1210*a*) for circulating air between resonance spaces.

The structure of the flat speaker unit 1200A is similar to the structure of the flat speaker unit 1000A', while the main difference therebetween lies in that the upper vibrating membrane structure of the flat speaker unit 1200A carries positive and negative electric charges, and the lower vibrating membrane structure of the flat speaker unit 1200A carries positive electric charges. Since the signals are output in a differential-out manner in this embodiment, the upper and lower vibrating membrane structures oscillate in the same direction. Each of the vibrating membrane structures includes an electret vibrating membrane and a conductive electrode thereof, such as the vibrating membrane 1230 and the metal electrode 1240, the vibrating membrane 1290 and the metal electrode 1280, the vibrating membrane 1292 and the metal electrode 1282, and the vibrating membrane 1232 and the metal electrode 1242.

A supporting layer can be selectively disposed between each vibrating membrane structure and the corresponding perforated electrode structure, so as to support the vibrating membrane structure and form a plurality of operation regions. Thereby, short circuit caused by the contact between the vibrating membranes 1230, 1232, 1290, and 1292 and the corresponding perforated electrode structures 1210, 1212, 1224, and 1226 because of electrostatic effects can be prevented. Additionally, the operation regions can serve as space allowing the vibrating membranes 1230, 1232, 1290, and 1292 to oscillate. The aforesaid supporting layer is, for example, the supporting layer 1220 disposed between the vibrating membrane 1230 and the perforated electrode structure 1210, the supporting layer 1214 disposed between the vibrating membrane 1290 and the perforated electrode structure 1224, the supporting layer 1216 disposed between the vibrating membrane 1292 and the perforated electrode structure 1226, and the supporting layer 1222 disposed between the vibrating membrane 1232 and the perforated electrode structure 1212. The supporting layers 1220, 1222, 1214, and 1216 respectively have frames 1225*a*, 1227*a*, 1217*a*, and 1219*a* and a plurality of supporting members 1225, 1227, 1217, and 1219. The supporting members 1225, 1227, 1217, and 1219 have different arrangements of patterns. Thereby, resonance spaces 1221, 1223, 1215, and 1218 as shown in the drawings are formed. As described above, the frames 1225*a*, 1227*a*, 1217*a*, and 1219*a* can have any geometrical shape, and the arrangement of patterns of the supporting layers 1220, 1222, 1214, and 1216 can be in any shape based on different demands. Thus, no further description is given herein.

Figure 12A:
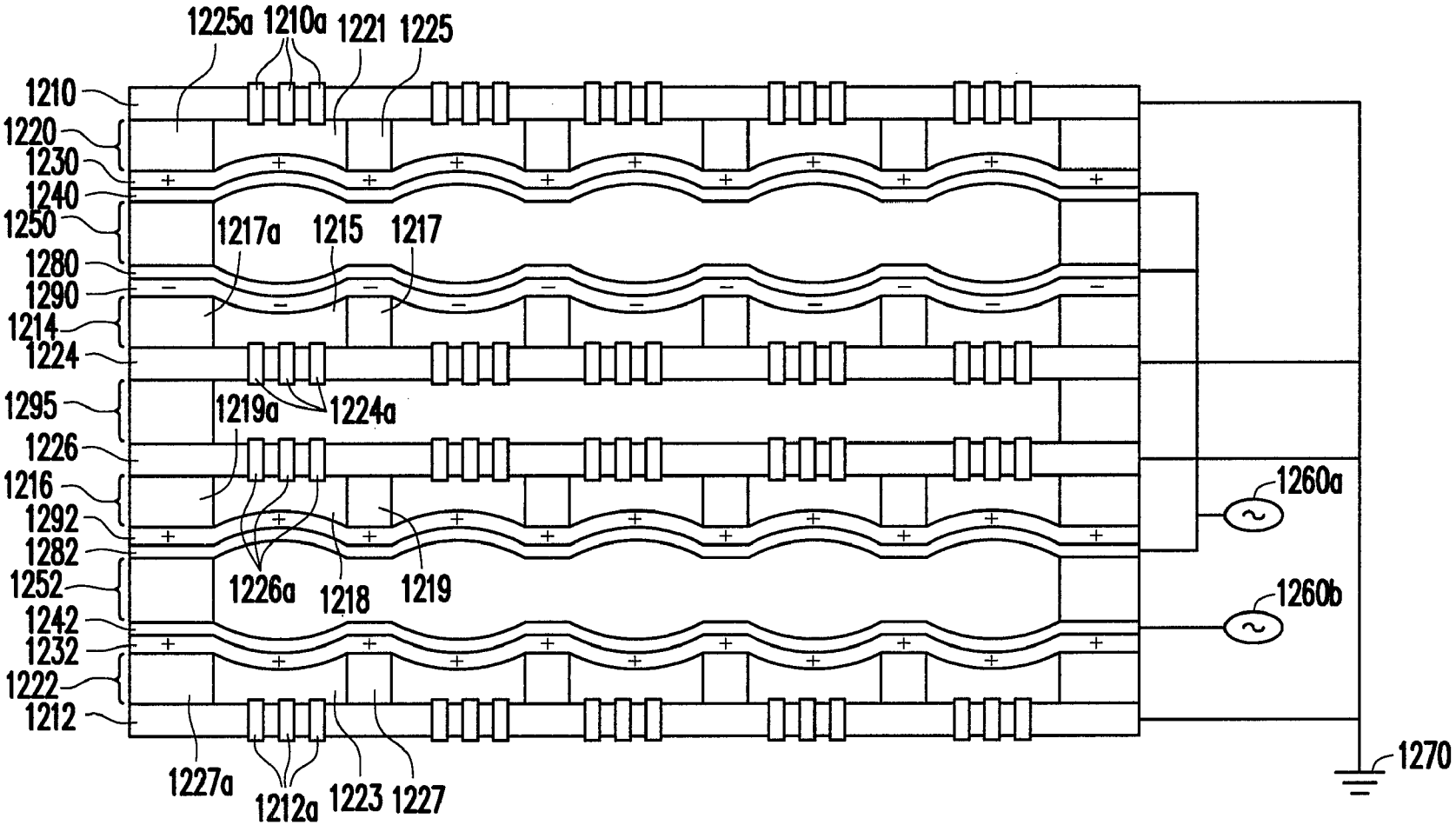
FIGS. 12A to 12C are schematic cross-sectional views illustrating a heteropolar flat speaker unit and a homopolar flat speaker unit in a flat loudspeaker having a stacked structure according to one of embodiments.

According to this embodiment, the vibrating membranes 1230, 1292, and 1232 of the flat speaker unit 1200A have positive electric charges, whereas the vibrating membrane 1290 has the negative electric charges. The connection relation of the signal sources 1260*a* and 1260*b* which provide the audio signals is shown in FIG. 12A. The signal source 1260*a* is connected to the metal electrodes 1240, 1280, and 1282 of the vibrating membranes 1230, 1290, and 1292, and the signal source 1260*b* is connected to the metal electrode 1242 of the vibrating membrane 1232. To prevent the EMI and the risk of electrocution, the perforated electrode structures 1210, 1212, 1224, and 1226 are connected to the ground 1270, such that the electric charges in the perforated electrode structures 1210, 1212, 1224, and 1226 can enter the ground.

In FIG. 12A, voltages are not yet supplied to the metal electrodes 1240, 1242, 1280, and 1282 by the signal sources 1260*a* and 1260*b*, whereas an electrostatic force is already applied to the vibrating membranes 1230, 1232, 1290, and 1292. Hence, an attractive force is generated between the positive electric charges of the vibrating membranes 1230, 1232, and 1292 and the negative electric charges of the perforated electrode structures 1210, 1212, and 1226. Thereby, the vibrating membranes 1230, 1232, and 1292 are slightly bent toward the resonance spaces 1221, 1223, and 1218.

Figure 12B:
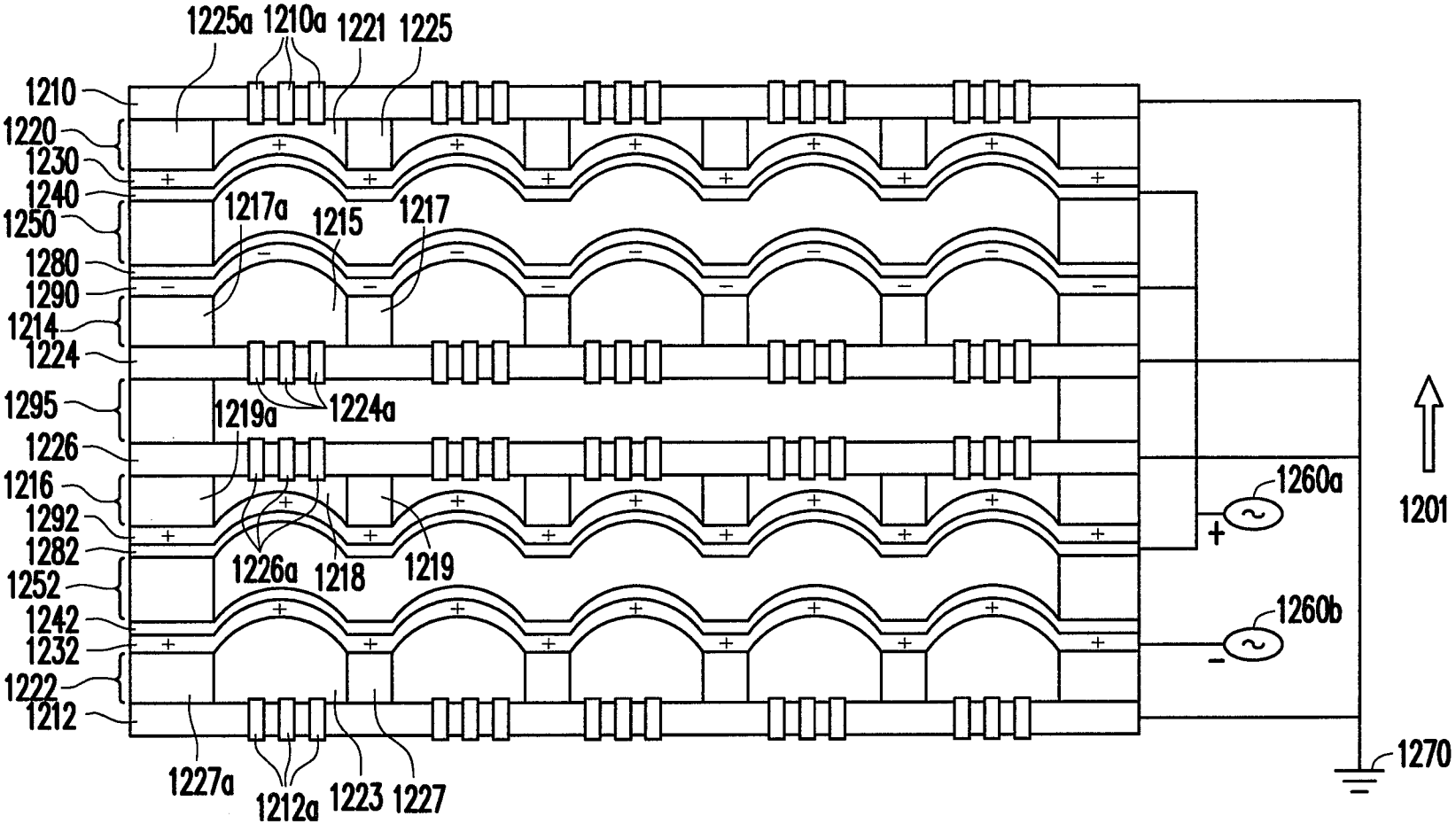
Figure 12C:
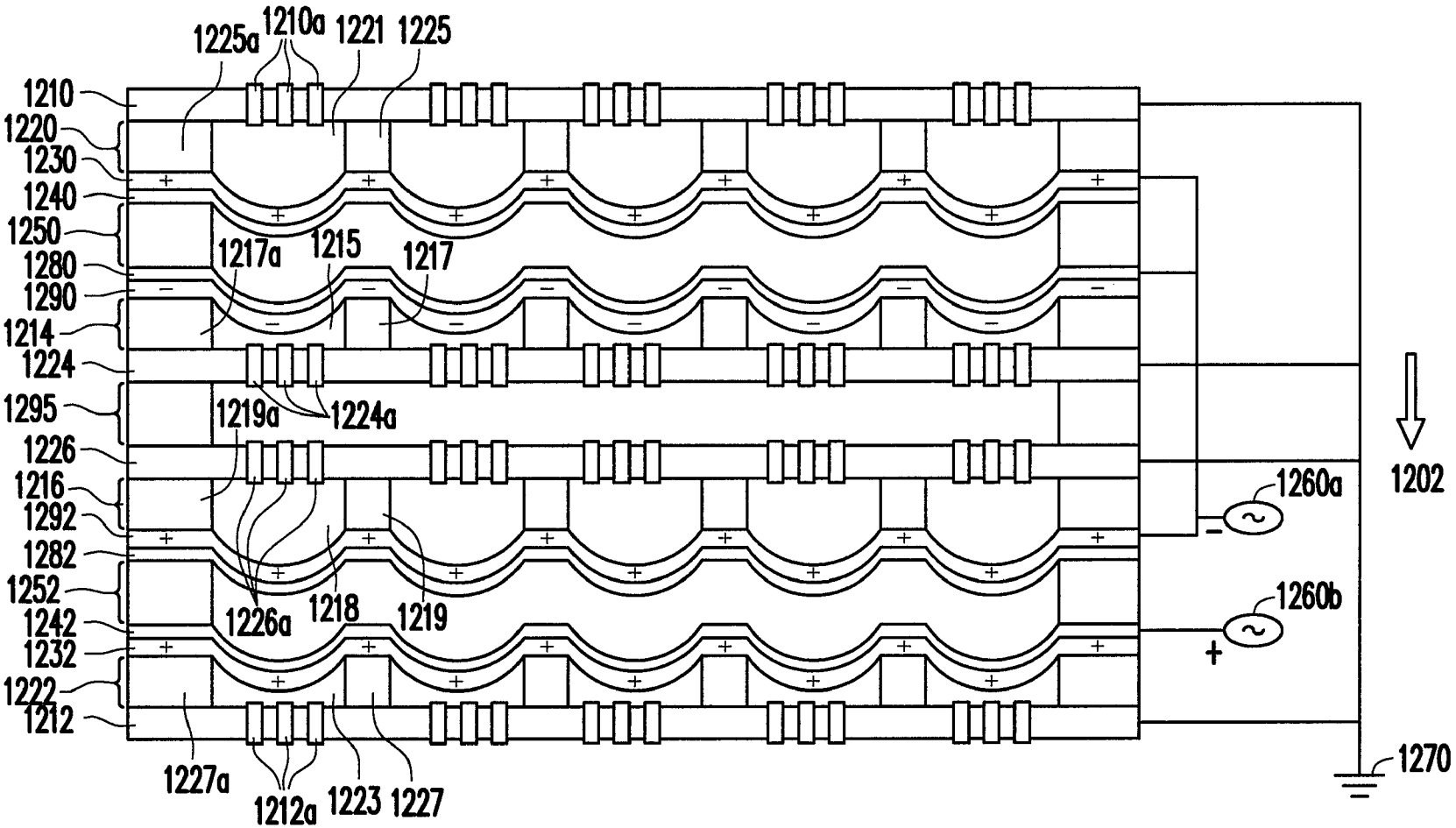

On the other hand, an attractive force is generated between the negative electric charges of the vibrating membrane 1290 and the positive electric charges of the perforated electrode structure 1224. Thereby, the vibrating membrane 1290 is slightly bent toward the resonance space 1215. As shown in FIG. 12B, when the positive voltage of the signal source 1260*a* is transmitted to the metal electrodes 1240, 1280, and 1282, a repulsive force is generated between the positive voltage on the metal electrodes 1240 and 1282 and the positive electric charges of the vibrating membranes 1230 and 1292, such that the vibrating membranes 1230 and 1292 are bent toward and compresses the resonance spaces 1221 and 1218. Simultaneously, an attractive force is generated between the positive voltage on the metal electrode 1280 and the negative electric charges of the vibrating membrane 1282, such that the vibrating membrane 1282 is bent toward a direction away from the resonance space 1215, and that the resonance space 1215 is then enlarged.

On the other hand, when the negative voltage of the signal source 1260*b* is transmitted to the metal electrode 1242, an attractive force is generated between the negative voltage on the metal electrode 1242 and the positive electric charges of the vibrating membrane 1232, such that the vibrating membrane 1232 is bent toward a direction away from the resonance space 1223, and that the resonance space 1223 is then enlarged. Accordingly, a force-loading direction of the entire vibrating membrane structure is shown as an arrow 1201.

In FIG. 12B, one differential phase of the audio signals of the signal sources 1260*a* and 1260*b* is depicted, which should not be construed as a limitation of the embodiment. For instance, when the phases of the signal sources 1260*a* and 1260*b* are opposite, a force-loading direction of the entire vibrating membrane structure is shown as the arrow 1201 in FIG. 12C. The audio signals that have alternate phases and are provided by the signal sources 1260*a* and 1260*b* allow the flat speaker unit 1200A to generate sound at different frequencies or with different volumes due to different force-loading directions of the vibrating membranes.

Apparently, the flat speaker unit 1200A of the above embodiment can also be formed by stacking two heteropolar vibrating membrane structures. This embodiment is not limited to the embodiments describe above.

In light of the foregoing, the flat speaker units can be assembled in various ways. More combinations are applicable to the multi-layered flat loudspeaker structure, given that the audio signals are output in a differential-out manner. It should be mentioned that the flat speaker units in the multi-layered flat loudspeaker structure can have the same polarity or different polarities when the audio signals are output in a differential-out manner. Besides, regardless of the number of the stacked flat speaker units, the utmost electrodes of the multi-layered flat loudspeaker structure must be grounded. The above embodiments merely demonstrate partial applications of the embodiment. The loudspeaker structure capable of, for example, preventing the EMI can have the flat speaker units assembled in various ways without being limited in this embodiment. Different combinations of the flat speaker units do not depart from the scope of the embodiment.

What is claimed is:

1. A flat loudspeaker comprising a plurality of stacked flat speaker units each comprising:

a perforated electrode structure having a plurality of holes;

a vibrating membrane structure, each of the vibrating membrane structures comprises an electret vibrating membrane and a conductive electrode stacked together; and a supporting layer disposed between the vibrating membrane structure and the perforated electrode structure, the supporting layer having a plurality of supporting members, wherein the vibrating membrane structure, the supporting layer, and the perforated electrode structure are sequentially stacked to form the flat speaker unit, the stacked flat speaker units comprise at least two of the flat speaker units having the conductive electrodes respectively located at two utmost opposite sides of the flat loudspeaker and grounded, and each of the vibrating membrane structures has a corresponding perforated electrode structure located at the side of the flat speaker unit, such as the perforated electrode structures facing the corresponding vibrating membrane structures.

2. The flat loudspeaker as claimed in claim 1, wherein the conductive electrodes of the vibrating membrane structures are together connected to a signal source.

3. The flat loudspeaker as claimed in claim 1, wherein parts of the conductive electrodes of the vibrating membrane structures are connected to a first signal source provided by a differential signal source, the other parts of the conductive electrodes of the vibrating membrane structures are connected to a second signal source provided by the differential signal source, and the first signal source and the second signal source have opposite phases.

4. The flat loudspeaker as claimed in claim 1, wherein the electret vibrating membranes of the vibrating membrane structures selectively have electric charges with different electrical properties, such that the vibrating membrane structures connected to a signal source oscillate and make a sound at different frequencies.

5. The flat loudspeaker as claimed in claim 1, wherein a material of the electret vibrating membranes is an electric piezoelectric composite material having nano-micro holes.

6. The flat loudspeaker as claimed in claim 1, wherein a material of the electret vibrating membranes is selected from a group consisting of fluorinated ethylenepropylene, polytetrafluoethylene, polyvinylidene fluride, fluorine polymer, or a combination thereof.

7. The flat loudspeaker as claimed in claim 1, wherein a material of the conductive electrodes is selected from a group consisting of aluminum, gold, silver, copper, an alloy thereof, an Ni/Au bi-metal material, one of indium tin oxide and indium zinc oxide or a combination thereof, or poly(3,4-ethylene dioxythiophene).

8. The flat loudspeaker as claimed in claim 1, the stacked flat speaker units comprising a first flat speaker unit and a second flat speaker unit, wherein the conductive electrodes located at the two utmost opposite sides of the flat loudspeaker and grounded are the perforated electrode structures in the first flat speaker unit and the second flat speaker unit.

9. The flat loudspeaker as claimed in claim 1, the stacked flat speaker units comprising a first flat speaker unit and a second flat speaker unit, wherein the conductive electrodes located at the two utmost opposite sides of the flat loudspeaker and grounded are the conductive electrodes in the first flat speaker unit and the second flat speaker unit.

10. The flat loudspeaker as claimed in claim 1, wherein the supporting members in each of the flat speaker units adjust arrangement of a pattern layout based on an electrostatic effect of the vibrating membrane structure and the perforated electrode structure.

11. The flat loudspeaker as claimed in claim 10, wherein the supporting members have a dot shape, a grid shape, a cross-like shape, a triangular column shape, a cylindrical shape, a rectangular shape, or a combination thereof.

12. The flat loudspeaker as claimed in claim 1, wherein the supporting layer further comprises a frame, the frame in each of the flat speaker units has a geometrical shape comprising a rectangular shape, a square shape, a triangular shape, a circular shape, an elliptical shape, or a combination thereof, and the supporting members are surrounded by the frame.

13. The flat loudspeaker as claimed in claim 1, further comprising an insulator layer located among the stacked flat speaker units and electrically insulating the stacked flat speaker units from one another, wherein a space among the stacked flat speaker units serves as a resonance space of the flat loudspeaker.

14. The flat loudspeaker as claimed in claim 1, further comprising an insulator layer located among the stacked flat speaker units and electrically insulating the stacked flat speaker units from one another, wherein a space among the stacked flat speaker units serves as a resonance space of the flat loudspeaker.

15. The flat loudspeaker as claimed in claim 1, wherein an insulator layer is disposed between every two of the flat speaker units to electrically insulate the two of the flat speaker units from each other, and a space between the two of the flat speaker units serves as a resonance space of the flat loudspeaker.

16. The flat loudspeaker as claimed in claim 15, wherein parts of the electret vibrating membranes carry a first electric charge, the other parts of the electret vibrating membranes carry a second electric charge, and a polarity of the first electric charge is opposite to a polarity of the second electric charge, such that the vibrating membrane structures connected to a signal source oscillate and allow the flat loudspeaker to make a sound at different frequencies.

17. A flat loudspeaker comprising a first flat speaker unit, a second flat speaker unit, and a third flat speaker unit stacked to one another, each of the first flat speaker unit, the second flat speaker unit, and the third flat speaker unit comprising:

a perforated electrode structure having a plurality of holes;

a vibrating membrane structure, each of the vibrating membrane structures comprises an electret vibrating membrane and a conductive electrode stacked together; and a supporting layer disposed between the vibrating membrane structure and the perforated electrode structure, the supporting layer having a plurality of supporting members, wherein the vibrating membrane structure, the supporting layer, and the perforated electrode structure are sequentially stacked to form one of the first flat speaker unit, the second flat speaker unit, and the third flat speaker unit, the electret vibrating membranes of the first and the second flat speaker units have a first electric charge, the electret vibrating membrane of the third flat speaker unit has a second electric charge, the conductive electrodes of the first, the second, and the third flat speaker units together connect a signal source, a polarity of the first electric charge is opposite to a polarity of the second electric charge, and the perforated electrode structures in the first and the second flat speaker units are respectively located at two utmost opposite sides of the flat loudspeaker.

18. A flat speaker unit comprising:

a first vibrating membrane structure having a first surface and a second surface, a first conductive electrode being disposed on the first surface;

a second vibrating membrane structure having a first surface and a second surface, a second conductive electrode being disposed on the first surface;

a perforated electrode structure located between the second surface of the first vibrating membrane structure and the second surface of the second vibrating membrane structure;

a first supporting layer disposed between the first vibrating membrane structure and the perforated electrode structure, the first supporting layer having a plurality of first supporting members; and a second supporting layer disposed between the second vibrating membrane structure and the perforated electrode structure, the second supporting layer having a plurality of second supporting members, wherein the first vibrating membrane structure, the first supporting layer, the perforated electrode structure, the second supporting layer, and the second vibrating membrane structure are stacked to form a stacked structure, and the first conductive electrode and the second conductive electrode are located at two utmost opposite sides of the stacked structure and form a resonance space in the stacked structure.

19. The flat speaker unit as claimed in claim 18, wherein the first conductive electrode and the second conductive electrode located at the two utmost opposite sides of the stacked structure are grounded.

20. The flat speaker unit as claimed in claim 18, wherein the perforated electrode structure is connected to a signal source.

21. The flat speaker unit as claimed in claim 18, wherein the supporting members adjust arrangement of a pattern layout based on an electrostatic effect of the first vibrating membrane structure, the second vibrating membrane structure, and the perforated electrode structure.

22. The flat speaker unit as claimed in claim 18, wherein the first supporting layer further comprising a first frame, and the second supporting layer further comprising a second frame, where both of the first frame and the second frame have a geometrical shape comprising a rectangular shape, a square shape, a triangular shape, a circular shape, or an elliptical shape.

23. The flat speaker unit as claimed in claim 18, wherein the first and the second supporting members have a dot shape, a grid shape, a cross-like shape, a triangular column shape, a cylindrical shape, or a rectangular shape.

24. The flat speaker unit as claimed in claim 18, wherein the first vibrating membrane structure and the second vibrating membrane structure respectively comprise an electret layer carrying electric charges.

25. The flat speaker unit as claimed in claim 24, wherein a material of the electret layers is an electric piezoelectric composite material having nano-micro holes.

26. The flat speaker unit as claimed in claim 24, wherein a material of the electret layers is selected from a group consisting of fluorinated ethylenepropylene, polytetrafluoethylene, polyvinylidene fluride, fluorine polymer, or a combination thereof.

27. The flat speaker unit as claimed in claim 18, wherein a material of the first and the second conductive electrodes is selected from a group consisting of aluminum, gold, silver, copper, an alloy thereof, an Ni/Au bi-metal material, one of indium tin oxide and indium zinc oxide or a combination thereof, or poly(3,4-ethylene dioxythiophene).

* * * * *